US012781983B2

(12) United States Patent
Lee et al.

(10) Patent No.: US 12,781,983 B2
(45) Date of Patent: Nov. 3, 2026

(54) AIR CONDITIONER AND CONTROL METHOD THEREOF

(71) Applicant: Samsung Electronics Co., Ltd., Suwon-si (KR)

(72) Inventors: Jaekil Lee, Suwon-si (KR); Chiwook Gu, Suwon-si (KR); Jun Hwang, Suwon-si (KR); Sangwoo Lee, Suwon-si (KR); Eunseob Kim, Suwon-si (KR); Jungmi Song, Suwon-si (KR); Jaehyuk Yang, Suwon-si (KR); Hyoshin Lee, Suwon-si (KR); Hyoungseo Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 22 days.

(21) Appl. No.: 18/999,184

(22) Filed: Dec. 23, 2024

(65) Prior Publication Data

US 2025/0251158 A1 Aug. 7, 2025

Related U.S. Application Data

(63) Continuation of application No. PCT/KR2024/020045, filed on Dec. 9, 2024.

(30) Foreign Application Priority Data

Feb. 6, 2024 (KR) ..... 10-2024-0018252
May 13, 2024 (KR) ..... 10-2024-0062738

(51) Int. Cl.
*F24F 11/00* (2018.01)
*F24F 11/65* (2018.01)
(Continued)

(52) U.S. Cl.
CPC ..... *F24F 11/0008* (2013.01); *F24F 11/65* (2018.01); *F24F 11/86* (2018.01); *F24F 13/222* (2013.01); *F24F 2120/10* (2018.01)

(58) Field of Classification Search
CPC ..... F24F 13/222; F24F 11/86; F24F 2120/10; F24F 11/65; F24F 11/0008
See application file for complete search history.

(56) References Cited

U.S. PATENT DOCUMENTS 4,439,995 A * 4/1984 McCarty ..... F25D 21/002 62/282
5,303,561 A * 4/1994 Bahel ..... F24F 11/77 62/186
(Continued)

FOREIGN PATENT DOCUMENTS

CN 114877485 A 8/2022
CN 116865882 A 10/2023
(Continued)

OTHER PUBLICATIONS

Search Report and Written Opinion dated Apr. 2, 2025 issued in International Patent Application No. PCT/KR2024/020045.

*Primary Examiner* — Lionel Nouketcha
(74) *Attorney, Agent, or Firm* — Nixon & Vanderhye, P.C.

(57) ABSTRACT

An air conditioner is configured to perform a drying operation to remove moisture inside a main body in response to the termination of a cooling operation while a drying function is activated; and configured to perform a ventilation operation to clean an inside of the main body in response to the presence of an occupant not being detected in a state in which the cooling operation or the drying operation is not in progress based on a ventilation function being activated.

20 Claims, 20 Drawing Sheets

(51) Int. Cl.

| | |
|---|---|
| ***F24F 11/86*** | (2018.01) |
| ***F24F 13/22*** | (2006.01) |
| *F24F 120/10* | (2018.01) |

(56) References Cited

U.S. PATENT DOCUMENTS

| | | | | |
|---|---|---|---|---|
| 6,058,722 | A * | 5/2000 | Choi | F25D 23/023 62/131 |
| 7,296,426 | B2 * | 11/2007 | Butler | F24F 11/42 236/1 C |
| 8,544,288 | B2 * | 10/2013 | MacDonald | F24F 3/153 236/44 C |
| 11,268,713 | B2 | 3/2022 | Kwon et al. | |
| 2023/0093074 | A1 * | 3/2023 | Joo | F24F 11/48 62/82 |

FOREIGN PATENT DOCUMENTS

| | | | |
|---|---|---|---|
| JP | 2008-224133 | | 9/2008 |
| JP | 2016-065687 | | 4/2016 |
| JP | 2016-109359 | | 6/2016 |
| JP | 2016-118371 | | 6/2016 |
| JP | 2017044424 | A | 3/2017 |
| KR | 10-2005-0037164 | | 4/2005 |
| KR | 20220008427 | A | 1/2022 |
| KR | 10-2368701 | | 2/2022 |
| KR | 102371180 | B1 | 3/2022 |
| KR | 10-2829785 | | 10/2024 |

* cited by examiner

AIR CONDITIONER AND CONTROL METHOD THEREOF

CROSS-REFERENCE TO RELATED APPLICATIONS

This application is a continuation of International Application No. PCT/KR2024/020045 designating the United States, filed on Dec. 9, 2024, in the Korean Intellectual Property Receiving Office and claiming priority to Korean Patent Application Nos. 10-2024-0018252, filed on Feb. 6, 2024, and 10-2024-0062738, filed on May 13, 2024, in the Korean Intellectual Property Office, the disclosures of each of which are incorporated by reference herein in their entireties.

BACKGROUND

Field

The disclosure relates to an air conditioner configured to perform a ventilation operation separately from a drying operation, and a control method thereof.

Description of Related Art

In general, an air conditioner is a device that cools or heats air using movement of heat generated during the evaporation and condensation of a refrigerant, and discharges the cooled or heated air to condition air in an indoor space.

In a cooling operation or a heating operation, the air conditioner may circulate the refrigerant and rotate a fan installed around an indoor heat exchanger to draw in indoor air. In addition, the air conditioner may exchange heat with the drawn air in the indoor heat exchanger and discharge the heat-exchanged air into the indoor space.

In addition, after the termination of the cooling operation, the air conditioner may perform a drying operation to remove moisture that is condensed on the indoor heat exchanger during the cooling operation. During the drying operation, the air conditioner may stop the circulation of the refrigerant and rotate the fan installed around the indoor heat exchanger to drop or evaporate the moisture condensed on the indoor heat exchanger.

A conventional air conditioner may evaporate moisture condensed on the indoor heat exchanger by performing the drying operation only after the termination of the cooling operation or by performing the drying operation when no occupant is present after the termination of the cooling operation. However, it is difficult for the conventional air conditioner to prevent/reduce a case in which organic chemicals attached to the indoor heat exchanger decompose and change into acidic substances to cause odor.

SUMMARY

Embodiments of the disclosure provide an air conditioner capable of performing a ventilation operation to remove volatile organic chemicals attached to a heat exchanger, separately from a drying operation to evaporate moisture condensed on the heat exchanger so as to prevent and/or reduce the growth of microorganisms, and a control method thereof.

Embodiments of the disclosure provide an air conditioner capable of, when a cooling operation is terminated, suppressing the growth of microorganisms by evaporating moisture condensed on a heat exchanger, and also capable of suppressing the growth of microorganisms in the absence of an occupant, and a control method thereof.

Embodiments of the disclosure provide an air conditioner capable of providing a feeling of comfort to an occupant by removing organic chemicals attached to a heat exchanger only when no occupant is present, and a control method thereof.

Embodiments of the disclosure provide an air conditioner capable of detecting the absence of an occupant without a separate sensor, and a control method thereof.

Embodiments of the disclosure provide an air conditioner capable of facilitating maintenance using a user device, and a control method thereof.

According to an example embodiment, the present disclosure provides an air conditioner including: a main body including a discharge port; a heat exchanger; a compressor configured to compress a refrigerant supplied from the heat exchanger; a blower fan configured to blow air, heat-exchanged by the heat exchanger, toward the discharge port; and a controller comprising circuitry configured to: perform a cooling operation by driving the compressor and the blower fan, and configured to perform a drying operation and a ventilation operation by driving the blower fan without driving the compressor; control the air conditioner to perform the drying operation to remove moisture inside the main body in response to the termination of the cooling operation while a drying function is activated; and control the air conditioner to perform the ventilation operation in response to the presence of an occupant not being detected in a state in which the cooling operation or the drying operation is not in progress while a ventilation function is activated.

According to an example embodiment, the disclosure provides a method of controlling an air conditioner including: performing a drying operation to remove moisture inside a main body in response to the termination of a cooling operation while a drying function is activated; and performing a ventilation operation in response to the presence of an occupant not being detected in a state in which the cooling operation or the drying operation is not in progress while a ventilation function is activated.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
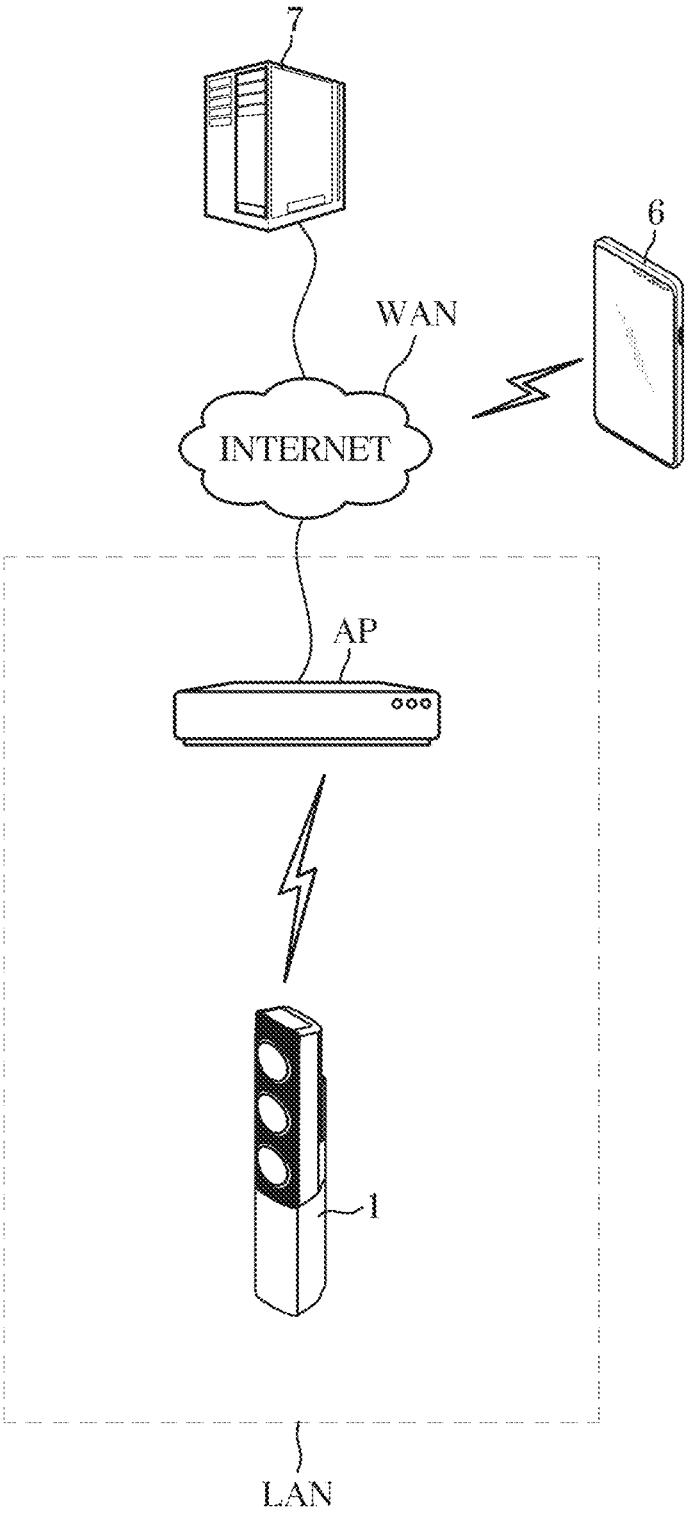
FIG. 1 is a diagram illustrating an example of an air conditioner control system including an air conditioner according to various embodiments.

Embodiments described in the disclosure and configurations shown in the drawings are merely examples of various example embodiments of the disclosure, and may be modified in various different ways at the time of filing of the present application to change the various embodiments and drawings of the disclosure.

The terms used herein are used to describe the various embodiments and are not intended to limit and/or restrict the disclosure The expressions "A or B," "at least one of A or/and B," or "one or more of A or/and B," and the like used herein may include any and all combinations of one or more of the associated listed items. For example, the term "A or B," "at least one of A and B," or "at least one of A or B" may refer to all of the case 1 where at least one A is included, the case 2 where at least one B is included, or the case 3 where both of at least one A and at least one B are included.

The singular forms "a," "an" and "the" are intended to include the plural forms as well, unless the context clearly indicates otherwise.

In this disclosure, the terms "including", "having", and the like are used to specify features, numbers, steps, operations, elements, components, or combinations thereof, but do not preclude the presence or addition of one or more of the features, numeric values, steps, operations, elements, components, or combinations thereof.

When an element is said to be "connected", "coupled", "supported" or "contacted" with another element, this includes not only when elements are directly connected, coupled, supported or contacted, but also when elements are indirectly connected, coupled, supported or contacted through a third element.

Throughout the disclosure, when an element is "on" another element, this includes not only when the element is in contact with the other element, but also when there is another element between the two elements.

It will be understood that when an element (e.g., a first element) is referred to as being "(operatively or communicatively) coupled to/to" or "connected to" another element (e.g., a second element), it can be directly coupled to/to or connected to the other element or an intervening element (e.g., a third element) may be present.

According to the situation, the expression "configured to" used herein may be used as, for example, the expression "suitable for," "having the capacity to," "designed to," "adapted to," "made to," or "capable of". The term "configured to" does not refer only to being "specifically designed to" in hardware.

Instead, the expression "a device configured to" may refer, for example, to the device being "capable of" operating together with another device or other components. For example, a "processor configured to perform A, B, and C" may refer, for example, to a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

The terms, such as "first," "second", and the like used herein may refer to various elements of various embodiments of the disclosure, but do not limit the elements. These terms are simply used to distinguish one element from another element.

In the following description, terms such as "unit", "part", "block", "member", and "module" indicate a unit for processing at least one function or operation. For example, those terms may refer to at least one process processed by at least one hardware such as Field Programmable Gate Array (FPGA), Application Specific Integrated Circuit (ASIC), at least one software stored in a memory or a processor.

Reference will now be made in greater detail to various embodiments of the disclosure, examples of which are illustrated in the accompanying drawings. Parts which are not associated with the description may be omitted in order to particularly describe the disclosure, and like reference numerals refer to like elements throughout the disclosure.

The disclosure will be described more fully hereinafter with reference to the accompanying drawings.

FIG. 1 is a diagram illustrating an example of an air conditioner control system including an air conditioner according to various embodiments.

Referring to FIG. 1, an air conditioner control system according to an embodiment may include an air conditioner 1, a user device 6 and/or a computing device (e.g., a server) 7.

The air conditioner 1 may include a communication interface (e.g., including communication circuitry) configured to communicate with the user device 6 and/or the computing device 7, a user interface device configured to receive a user input or to output various types of information, at least one processor configured to control an operation of the air conditioner 1, and at least one memory provided to store a program for controlling the operation of the air conditioner 1.

The computing device 7 may include a server device.

The computing device 7 may include a communication interface configured to communicate with the air conditioner 1 and/or the user device 6. The computing device 7 may include at least one processor (e.g., including various processing circuitry) configured to process data received from the air conditioner 1, another computing device (or another server device), and/or the user device 6, and at least one memory provided to store a program for processing the data or provided to store processed data. The computing device 7 may be implemented as various computing devices such as a workstation, Google Cloud, a data drive, a data station, etc. The computing device 7 may be implemented as one or more servers that are physically or logically separated based on functions, detailed configurations of functions, or data, and may transmit and receive data and process the transmitted and received data through the communication between each server.

The computing device 7 may store and/or manage a user account, register the air conditioner 1 and/or the user device 6 by linking the air conditioner 1 and/or the user device 6 to the user account, and perform functions of managing or controlling the registered air conditioner 1 and/or the user device 6. For example, a user can access the computing device 7 through the user device 6 and generate a user account. The user account may be identified by an identification (ID) and password set by the user. The user can access the computing device 7 through the user device 6 and manage the user account. The computing device 7 may register the air conditioner 1 and/or the user device 6 on the user account according to a set procedure. For example, the computing device 7 may link identification information (e.g., serial number or MAC address, etc.) of the air conditioner 1 to the user account to register, manage, and control the air conditioner 1. Likewise, the computing device 7 may register the user device 6 on the user account, and control the user device 6.

According to various embodiments, the computing device 7 may include a plurality of servers.

For example, the computing device 7 may include a first server device and a second server device. The first server device may generate and/or manage user account information, and register information of the air conditioner 1 and/or the user device 6 on the user account information, and/or manage the information of the air conditioner 1 and/or the user device 6. The second server device may receive registration information of the air conditioner 1 and/or the user device 6 from the first server device, and control the air conditioner 1 and/or the user device 6.

As another example, on behalf of the first server device, the second server device may perform a management function of the air conditioner 1 and/or the user device 6 registered on the first server device.

The number of computing devices 7 is not limited thereto, and the computing devices 7 may include a plurality of servers for performing the same operation and/or different operations.

The user device 6 may include a communication interface including various communication circuitry configured to communicate with the air conditioner 1 and/or the computing device 7. The user device 6 may include a user interface device configured to receive a user input or to output information to a user. The user device 6 may include at least one processor configured to control the operation of the user device 6, and at least one memory provided to store a program for controlling the operation of the user device 6.

The user device 6 may be carried by a user or placed in the user's house or office, etc. The user device 6 may include a personal computer, a terminal, a mobile phone, a smart phone, a handheld device, a wearable device, a display device, etc., but is not limited thereto.

According to an embodiment, the user device 6 may include a remote-control device configured to remotely control the air conditioner 1. The remote-control device may include various interfaces for controlling the air conditioner 1 or for setting the air conditioner 1. In an embodiment, when the user device 6 corresponds to the remote-control device configured to remotely control the air conditioner 1, the air conditioner 1 and the user device 6 may perform direct-communication.

The memory of the user device 6 may store a program, e.g., an application, for controlling the air conditioner 1 and/or the computing device 7. The application may be sold after being installed on the user device 6 or the application may be installed after being downloaded from an external server.

A user can access the computing device 7 by executing an application installed on the user device 6, generate a user account, and perform communication with the computing device 7 based on the logged-in user account, thereby registering the air conditioner 1 on the computing device 7.

For example, when a user manipulates the air conditioner 1 to allow the air conditioner 1 to access to the computing device 7 according to the procedure guided by the application installed on the user device 6, the air conditioner 1 may be registered on the user account by registering the identification information (e.g., serial number or MAC address) of the air conditioner 1 on the corresponding user account on the computing device 7. It should be understood that the information required to register a device such as the air conditioner 1 on the user account may be other information for identifying the device in addition to the serial number or MAC address of the device.

A user can control the air conditioner 1 using the application installed on the user device 6. For example, when the user logs into the user account using the application installed on the user device 6, a visual indicator indicating the air conditioner 1 registered on the user account may appear. When a control command for the air conditioner 1 is input through the user device 6, the user device 6 may transmit the control command to the air conditioner 1 through the computing device 7.

The user device 6 may receive various information from the air conditioner 1 through the computing device 7 or the user device 6 may receive various information directly from the air conditioner 1 registered on the user account.

A network may include both wired and wireless networks. Wired networks may include cable networks or telephone networks, and wireless networks may include any network that transmits and receives signals via radio waves. Wired and wireless networks may be connected to each other.

A network may include a wide area network (WAN) such as the Internet, a local area network (LAN) formed around an Access Point (AP), and a short-range wireless network that does not use an Access Point (AP). Short-range wireless networks may include Bluetooth™ (IEEE 802.15.1), Zigbee (IEEE 802.15.4), Wi-Fi Direct, Near Field Communication (NFC), Z-Wave, etc., but is not limited thereto.

The access point (AP) may connect the air conditioner 1 and/or the user device 6 to a wide area network (WAN) to which the computing device 7 is connected. The air conditioner 1 and/or the user device 6 may be connected to the computing device 7 via the wide area network (WAN).

The access point (AP) may communicate with the air conditioner 1 and/or the user device 6 using wireless communication such as Wi-Fi™ (IEEE 802.11), Bluetooth™ (IEEE 802.15.1), and Zigbee (IEEE 802.15.4), and may access to the wide area network (WAN) using wired communication, but the wireless communication method of the access point (AP) is not limited thereto.

The access point (AP) may output radio waves for wireless communication. The air conditioner 1 may receive radio waves output from the access point (AP). For this, the air conditioner 1 may include an antenna (communication interface 140) for receiving radio waves output from the access point (AP).

Radio waves output from the access point (AP) may include signals for wireless communication such as Wi-Fi™ (IEEE 802.11), Bluetooth™ (IEEE 802.15.1), and Zigbee (IEEE 802.15.4).

According to various embodiments, the air conditioner 1 may be directly connected to the user device 6 and/or the computing device 7 without passing through the access point (AP).

The air conditioner 1 may be connected to the user device 6 and/or the computing device 7 via the long-range wireless network or the short-range wireless network.

For example, the air conditioner 1 may be connected to the computing device 7 and/or the user device 6 via the short-range wireless network (e.g., Wi-Fi Direct and Bluetooth). As another example, the air conditioner 1 may be connected to the user device 6 and/or the computing device 7 via the wide area network (WAN) using the long-range wireless network (e.g., a cellular communication module).

The air conditioner 1 may transmit information about the operation or status of the air conditioner 1 to the user device 6 and/or the computing device 7 via the network. For example, the air conditioner 1 may transmit information about the operation or status to the user device 6 and/or the computing device 7 when a request is received from the user device 6 and/or the computing device 7, when a specific event occurs in the air conditioner 1, and/or periodically or in real time.

When receiving information about the operation or status from the air conditioner 1, the computing device 7 may update the stored information about the operation or status of the air conditioner 1 and transmit the updated information about the operation and/or status of the air conditioner 1 to the user device 6 via the network. The update of information may include various operations in which existing information is changed, such as an operation of adding new information to existing information and an operation of replacing existing information with new information.

The information about the operation and/or status of the air conditioner 1 may include information related to the operation of the air conditioner 1.

For example, the information related to the operation of the air conditioner 1 may include information about an operation start time and an operation end time of the air conditioner 1.

The information about the operation and/or status the air conditioner 1 may include information collected by at least one sensor provided in the air conditioner 1.

For example, the information about the operation and/or status of the air conditioner 1 may include humidity information, temperature information and/or quality information of the surrounding air.

The air conditioner 1 may obtain various information from the user device 6 and/or the computing device 7, and provide the obtained information to a user. For example, the air conditioner 1 may obtain information about the function of the air conditioner 1 and various environmental information (e.g., weather, temperature, humidity, air quality, etc.) from the computing device 7, and output the obtained information through a user interface device (e.g., display).

The air conditioner 1 may receive electrical signals corresponding to various notifications from the user device 6 and/or the computing device 7, and provide a notification corresponding to the electrical signal to a user.

The user device 6 may receive electrical signals corresponding to various notifications from the air conditioner 1 and/or the computing device 7, and provide a notification corresponding to the electrical signal to a user.

The air conditioner 1 may operate according to a control command received from the user device 6 and/or the computing device 7. For example, when the air conditioner 1 obtains prior approval from a user so as to operate according to the control command of the computing device 7 even without a user input through the user device 6, the air conditioner 1 may operate according to the control command received from the computing device 7. The control command received from the computing device 7 may include a control command input by a user through the user device 6 or a control command based on preset conditions, but is not limited thereto.

The user device 6 may transmit information about a user to the air conditioner 1 and/or the computing device 7 via the communication interface. For example, the user device 6 may transmit information about a user's location, a user's health status, a user's preferences, a user's schedule, etc. to the computing device 7. The user device 6 may transmit information about the user to the computing device 7 according to the user's prior approval.

In an embodiment, the user device 6 may transmit settings related to the air conditioner 1 (e.g., settings for a drying operation) to the air conditioner 1 and/or the computing device 7 via the communication interface.

The air conditioner 1, the user device 6, and/or the computing device 7 may determine a control command using artificial intelligence technology. For example, the computing device 7 may process information about the operation or status of the air conditioner 1 and information about the user of the user device 6 using artificial intelligence technology, and transmit the processing result or the control command to the air conditioner 1 and/or the user device 6 based on the processing result.

FIG. 1 is a diagram illustrating an example of the air conditioner control system according to various embodiments in which the air conditioner 1, the user device 6 and/or the computing device 7 exchange information and/or control commands with each other. The communication method of the air conditioner 1, the user device 6 and/or the computing device 7 or examples of information transmitted from the air conditioner 1, the user device 6 and/or the computing device 7 are not limited to the above-described description.

Figure 2:
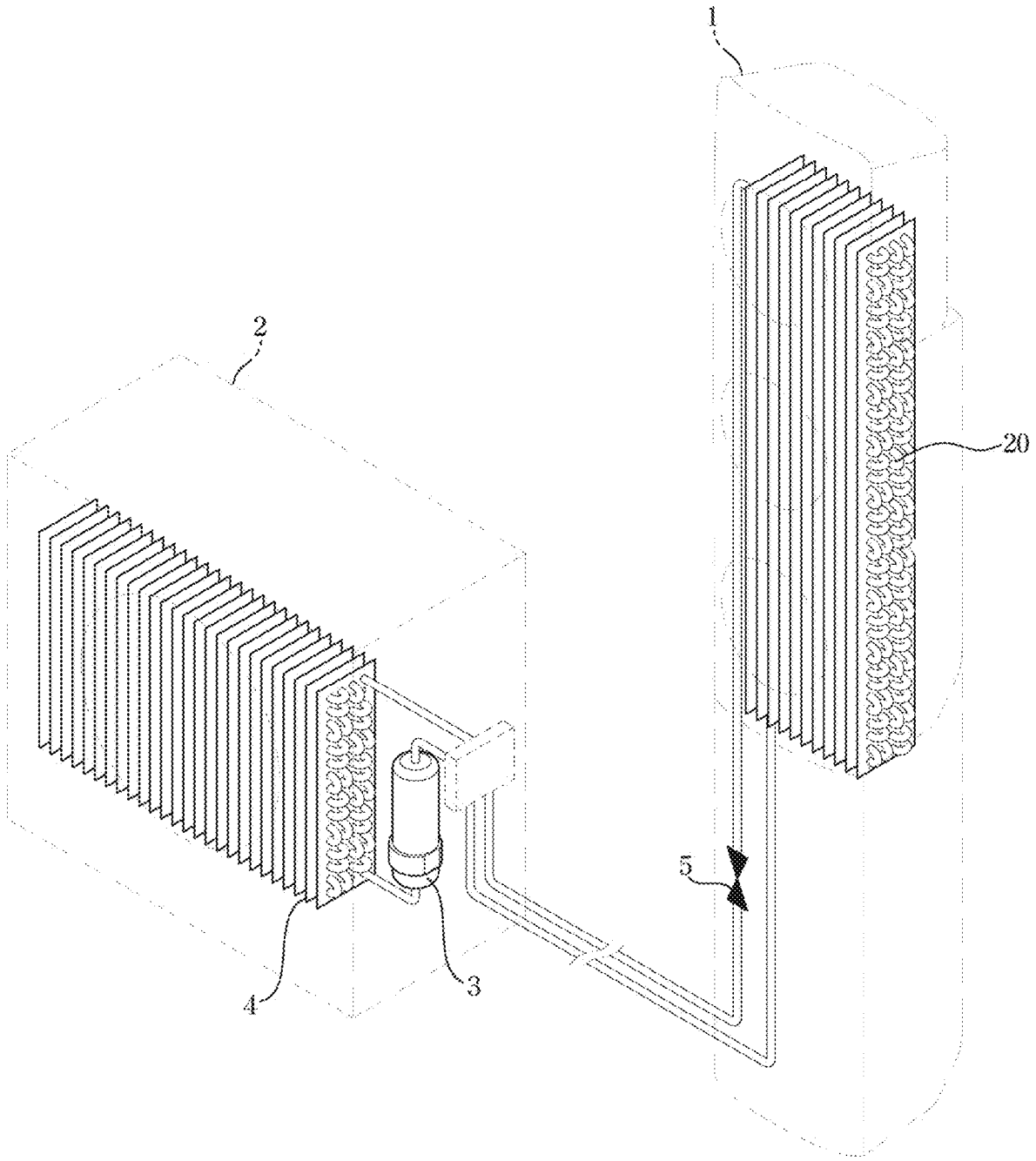
FIG. 2 is a diagram illustrating an example refrigerant circulation circuit of an air conditioning system according to various embodiments.

FIG. 2 is a diagram illustrating an example refrigerant circulation circuit of an air conditioning system according to various embodiments.

Referring to FIG. 2, the air conditioning system includes the air conditioner 1 and an outdoor unit 2. The air conditioner 1 may be referred to as 'indoor unit' because the air conditioner is located in an indoor space requiring air conditioning. The air conditioner 1 may be installed inside a space separated from the outside by a wall or a partition, such as an inside of a house or an inside of an office.

The outdoor unit 2 may be located outside the air conditioning space. The outdoor unit 2 may be provided outdoors.

The air conditioning system includes a refrigerant flow path that circulates a refrigerant between indoors and outdoors. The refrigerant may circulate between indoors and outdoors along the refrigerant flow path, and may absorb heat or release latent heat during a change of state (e.g., from a gas to a liquid, or from a liquid to a solid).

To induce the state change of the refrigerant, a refrigerant circulation device may include a compressor 3, an outdoor heat exchanger 4, an expansion valve 5, and an indoor heat exchanger 20.

The compressor 3 may compress the gaseous refrigerant, thereby heating the refrigerant. The high temperature/high pressure gaseous refrigerant may be transferred to the outdoor heat exchanger 4 by the compressor 3. In the outdoor heat exchanger 4, the high temperature/high pressure gaseous refrigerant is converted from a gaseous state to a liquid state and also releases heat. The liquid refrigerant may be transferred to the expansion valve 5. The expansion valve 5 reduces the pressure of the liquid refrigerant, thereby cooling the refrigerant. The low temperature/low pressure liquid refrigerant may be transferred to the indoor heat exchanger 20. In the indoor heat exchanger 20, the low temperature/low pressure liquid refrigerant is converted from a liquid state to a gaseous state and also absorbs heat.

As mentioned above, the refrigerant may release heat in the outdoor heat exchanger 4 and absorb heat in the indoor heat exchanger 20. The indoor heat exchanger 20 may be installed in the air conditioner 1 together with the expansion valve 5, and the outdoor heat exchanger 4 may be installed in the outdoor unit 2 together with the compressor 3. Therefore, the indoor heat exchanger 20 may cool the air in the air conditioning space (indoor).

Hereinafter for convenience of description, the indoor heat exchanger 20 may be referred to as a 'heat exchanger 20'. In addition, components provided in the outdoor unit 2 may also be components of the air conditioner 1, and the air conditioner 1 may be a concept that includes both the indoor unit 1 and the outdoor unit 2.

Figure 3:
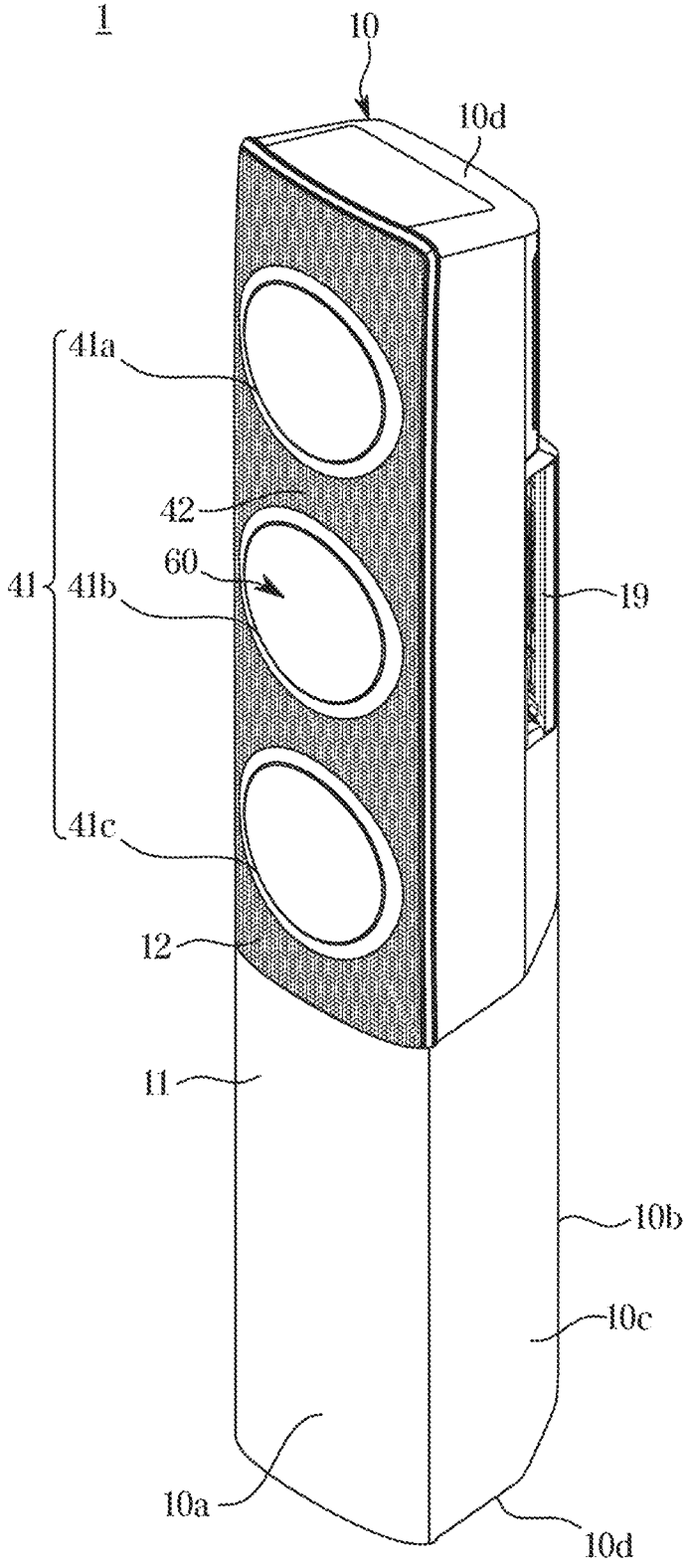
FIG. 3 is a perspective view illustrating an example air conditioner according to various embodiments.
Figure 4:
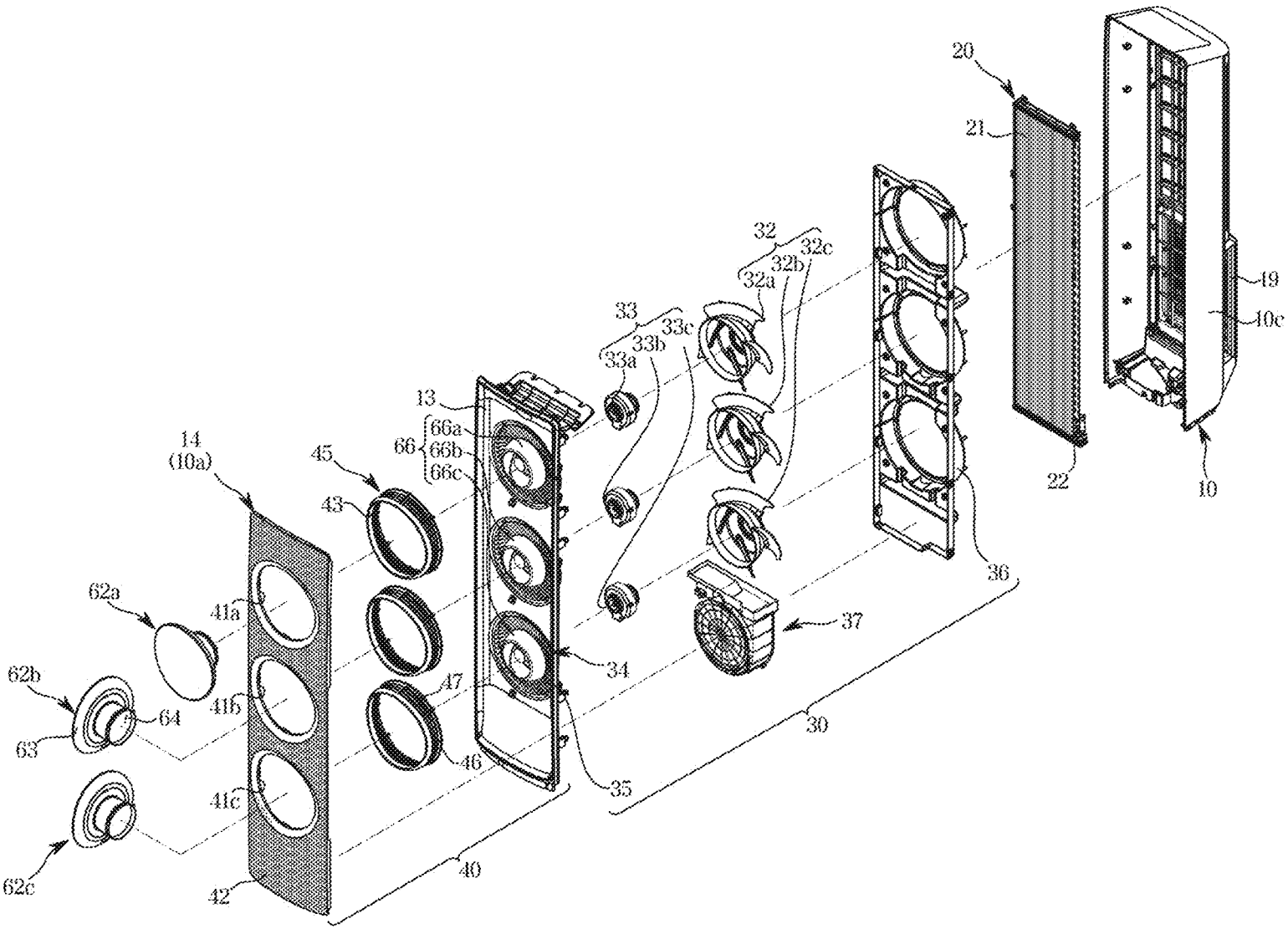
FIG. 4 is an exploded perspective view of the air conditioner according to various embodiments.
Figure 5:
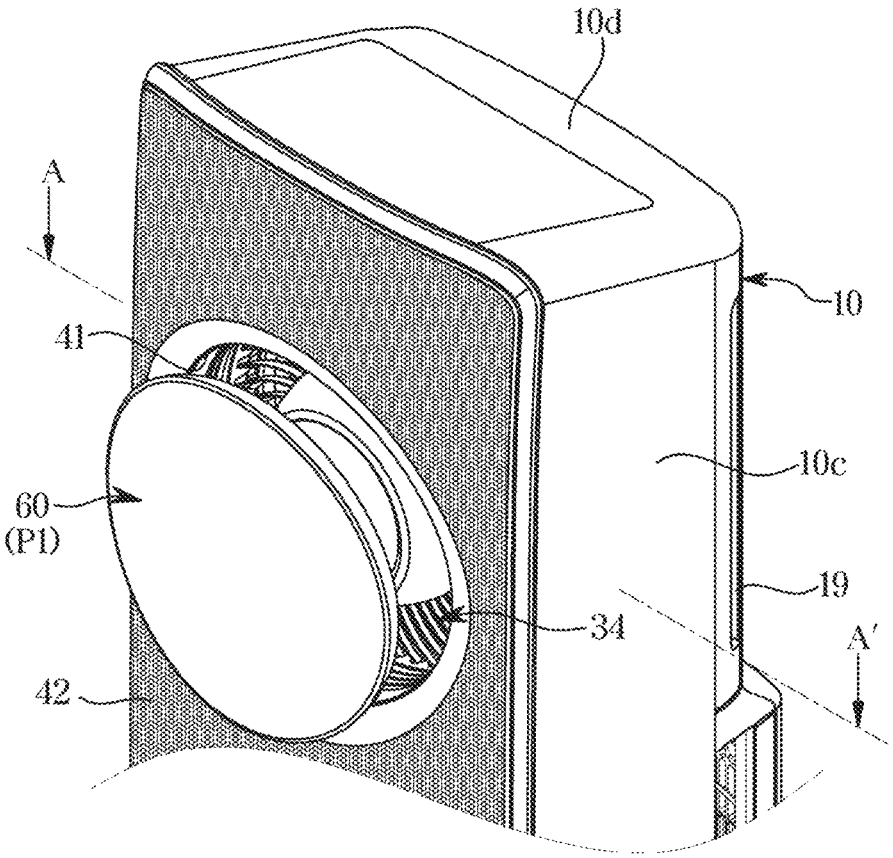
FIG. 5 is a partial perspective view illustrating a state in which a discharge port of the air conditioner is open according to various embodiments.
Figure 6:
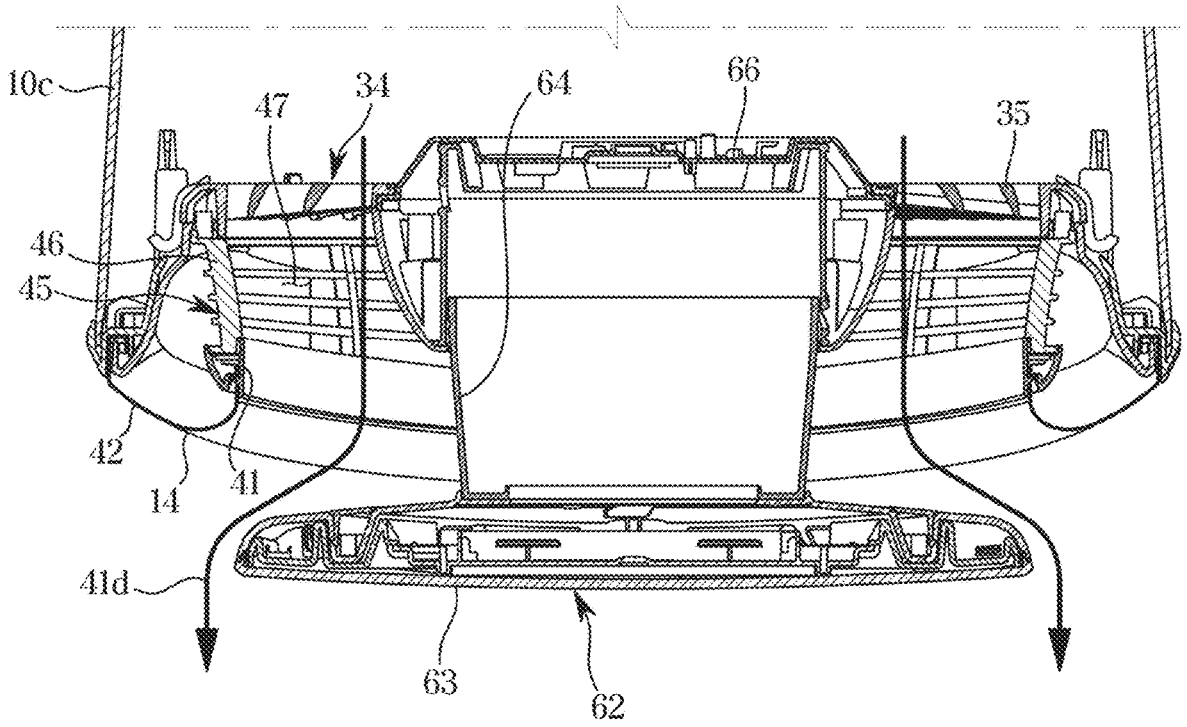
FIG. 6 is a cross-sectional view taken along line A-A' of FIG. 5 according to various embodiments.
Figure 7:
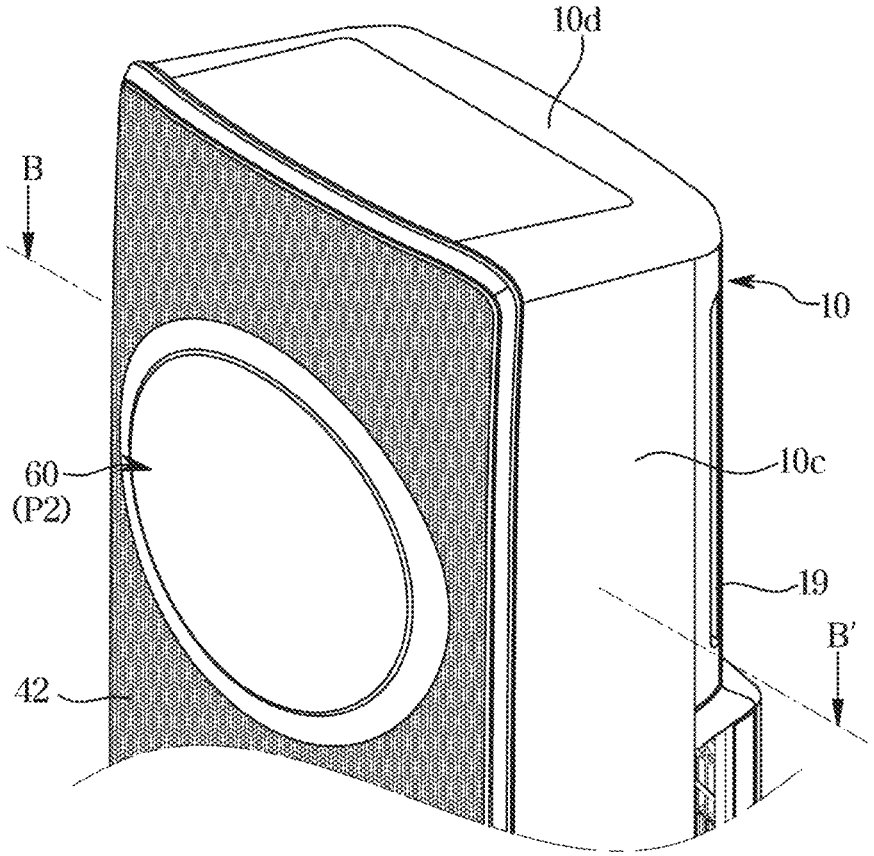
FIG. 7 is a partial perspective view illustrating a state in which the discharge port of the air conditioner is closed according to various embodiments.
Figure 8:
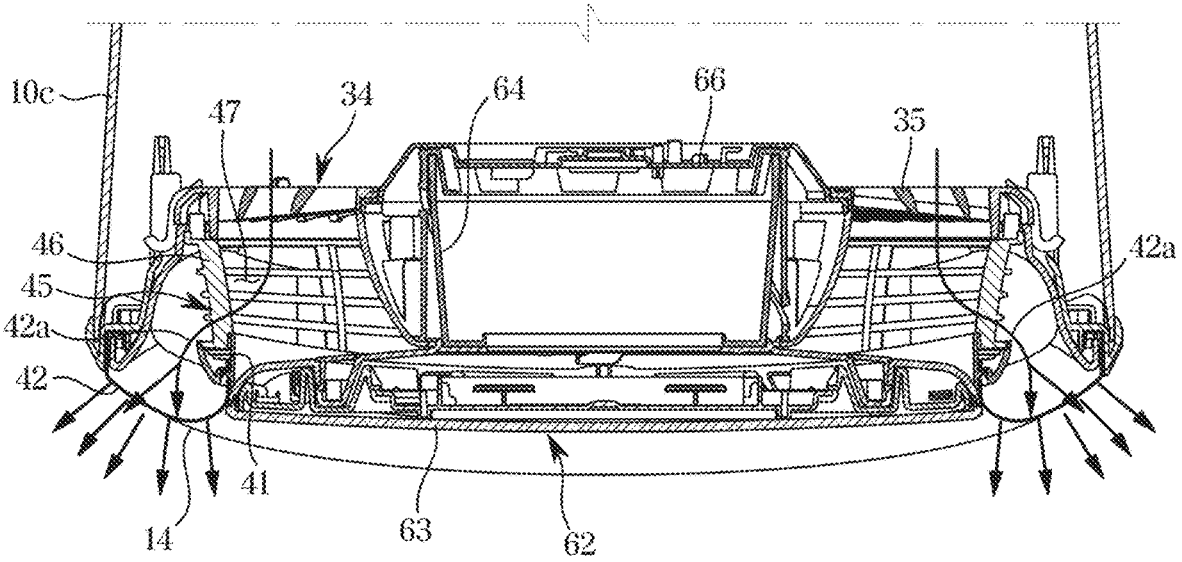
FIG. 8 is a cross-sectional view taken along line B-B' of FIG. 7 according to various embodiments.

FIG. 3 is a perspective view illustrating an example air conditioner according to various embodiments. FIG. 4 is an exploded perspective view of the air conditioner according to various embodiments. FIG. 5 is a partial perspective view illustrating a state in which a discharge port of the air conditioner is open according to various embodiments. FIG. 6 is a cross-sectional view taken along line A-A' of FIG. 5 according to various embodiments. FIG. 7 is a partial perspective view illustrating a state in which the discharge port of the air conditioner is closed according to various embodiments. FIG. 8 is a cross-sectional view taken along line B-B' of FIG. 7 according to various embodiments.

Referring to FIGS. 3, 4, 5, 6, 7 and 8 (which may be referred to as FIGS. 3 to 8), the air conditioner 1 includes a main body 10 including at least one discharge port 41, the heat exchanger 20 configured to exchange heat with air flowing into an inside of the main body 10, a blowing portion 30 configured to circulate air into or out of the main body 10, and a discharge portion 40 configured to discharge air blown from the blowing portion 30 to an outside of the main body 10.

The main body 10 may include a front panel 10*a* in which the at least one discharge port 41 is formed, a rear panel 10*b* arranged at the rear of the front panel 10*a*, a side panel 10*c* arranged between the front panel 10*a* and the rear panel 10*b*, and upper/lower panels 10*d* arranged at upper and lower portions of the side panel 10*c*. The at least one discharge port 41 may be provided in a circular shape, and two or more discharge ports may be spaced apart from each other in the up/down direction of the front panel 10*a*. For example, the discharge port 41 may include a first discharge port 41*a*, a second discharge port 41*b*, and a third discharge port 41*c*.

An intake port 19 may be formed on the rear panel 10*b* to allow external air to be drawn into the inside of the main body 10.

The intake port 19 may be provided on the rear panel 10*b* located at the rear of the heat exchanger 20 and may guide air from the outside of the main body 10 to flow into the inside of the main body 10. Air that flows into the inside of the main body 10 through the intake port 19 may absorb or lose heat as the air passes through the heat exchanger 20. Air that is heat-exchanged by passing through the heat exchanger 20 may be discharged to the outside of the main body 10 through the discharge portion 40 by the blowing portion 30.

The blowing portion 30 may include a blower fan 32 and a grille 34.

The grille 34 may be disposed on a discharge direction of the blower fan 32. In an embodiment, a diagonal fan is applied to the blower fan 32, but the type of the blower fan 32 is not limited thereto, and it is sufficient that a configuration is configured to allow air introduced from the outside of the main body 10 to be discharged back to the outside of the main body 10. For example, the blower fan 32 may be a cross fan, a turbo fan, or a sirocco fan. The number of blower fans 32 is not limited thereto, and according to an embodiment, at least one blower fan 32 may be provided to correspond to at least one discharge port 41. For example, the blower fan 32 may include a first blower fan 32*a*, a second blower fan 32*b*, and a third blower fan 32*c*.

The blowing portion 30 may be provided with a fan motor 33 disposed at the center of the blower fan 32 and configured to drive the blower fan 32. For example, the fan motor 33 may include a first fan motor 33*a* configured to drive the first blower fan 32*a*, a second fan motor 33*b* configured to drive the second blower fan 32*b*, and a third fan motor 33*c* configured to drive the third blower fan 32*c*. The fan motor 33 may include a motor configured to control a rotation speed. For example, the fan motor 33 may be a Brush Less Direct Current (BLDC) motor.

According to the present disclosure, controlling the blower fan 32 may include controlling the fan motor 33.

The grille 34 may be arranged in front of the blower fan 32 to guide airflow. In addition, the grille 34 may be arranged between the blower fan 32 and the discharge port 41 to minimize and/or reduce external influences on the blower fan 32.

The blower fan 32 may blow air, which is heat-exchanged by the heat exchanger 20, to the discharge port 41.

The grille 34 may include a plurality of blades 35. The plurality of blades 35 may adjust a wind direction or an amount of air blown from the blower fan 32 to the discharge port 41 by adjusting the number, shape, and arrangement angle thereof.

A center of the grille 34 may be provided to allow a door actuator 66 described in greater detail below to be disposed thereon. The door actuator 66 and the fan motor 33 may be disposed on the same line in the front and rear direction.

With the configuration, the plurality of blades 35 of the grille 34 may be disposed in front of the blower fan 32.

According to various embodiments, the blowing portion 30 may further include a circular fan 37.

The circular fan 37 may be installed in an accommodating space 37*s* provided on one side of the heat exchanger 20. The circular fan 37 may be configured not to blow air toward the discharge port 41 unlike the blower fan 32. Unlike the blower fan 32, the circular fan 37 may blow air that is not heat-exchanged by the heat exchanger 20.

The circular fan 37 may blow air that is outside the air conditioner 1 and does not pass through the heat exchanger 20. The circular fan 37 may include a fan motor.

According to the present disclosure, controlling the circular fan 37 may include controlling the fan motor of the circular fan 37.

The circular fan 37 may blow air outside the air conditioner 1 toward the blower fan 32.

For example, the circular fan 37 may include a fan discharge port connected to a duct that is connected in the direction of the blower fan 32, and when the circular fan 37 operates, air may flow into the duct through the fan discharge port and be blown to the blower fan 32.

For example, the circular fan 37 may cause air, which is not heat-exchanged by the heat exchanger 20, to flow to the inside of the air conditioner 1.

When the circular fan 37 operates, air, which is not heat-exchanged by the heat exchanger 20, may flow into the air conditioner 1, and thus foreign substances (e.g., dust, organic chemicals, etc.) attached to the inside of the main body 10 of the air conditioner 1 (e.g., the blower fan 32 and/or the heat exchanger 20) may be removed.

Further, when the circular fan 37 operates, a portion of the air may leak out of the air conditioner 1 through a discharge hole 42 described in greater detail below.

The blowing portion 30 may include a duct 36. The duct 36 may be formed in a circular shape, which surrounds the blower fan 32, so as to guide the flow of air flowing to the blower fan 32.

The accommodating space 37*s*, in which the circular fan 37 is installed, may be provided in the duct 36.

The heat exchanger 20 may be disposed between the blower fan 32 and the intake port 19, and absorb heat from air introduced through the intake port 19 or transfer heat to air introduced through the intake port 19. The heat exchanger 20 may include a tube 21 and a header 22 coupled to upper and lower sides of the tube 21. However, the type of the heat exchanger 20 is not limited thereto.

The number of heat exchangers 20 disposed in the main body 10 may be at least one to correspond to the number of discharge ports 41. For example, the discharge port 41 may include the first discharge port 41*a*, the second discharge port 41*b*, and the third discharge port 41*c*.

The air conditioner 1 may perform a plurality of operations. The plurality of operations may include a cooling operation in which heat-exchanged air is discharged through the discharge port 41, and a drying operation in which non-heat-exchanged air is discharged through the discharge port 41 and/or the discharge hole 42. The drying operation may also be referred to as 'blowing operation' in that the drying operation discharges non-heat-exchanged air. According to various embodiments, the drying operation may include a blowing operation in which only the blower fan 32 operates without operating the compressor 3, and/or a heating operation in which the blower fan 32 operates together with the operation of the compressor 3.

According to an embodiment, the plurality of operations may include a ventilation operation in which non-heat-exchanged air is discharged through the discharge port 41 and/or the discharge hole 42.

The ventilation operation may be an operation mode for cleaning the inside of the main body 10 by moving air inside the main body 10.

Cleaning the inside of the main body 10 may include removing foreign substances (e.g., dust, organic chemicals, etc.) from the inside of the main body 10.

The ventilation operation may be distinguished from the drying operation in that whether to perform the ventilation operation is determined by the presence or absence of an occupant. When the ventilation operation is performed while an occupant is present, a user can feel uncomfortable due to smell or noise that may be generated when removing foreign substances.

The ventilation operation may also be referred to as 'operation when no occupant is present' in that the ventilation operation is to be performed only when no occupant is present and thus not cause discomfort to the occupant.

The purpose of the ventilation operation is to remove foreign substances (e.g., dust, organic chemicals, etc.) attached to the blower fan 32 and/or the heat exchanger 20 rather than to remove moisture inside the air conditioner 1 (e.g., moisture around the heat exchanger 20), and thus it may also be referred to as a 'cleaning operation'.

The air conditioner 1 may perform the ventilation operation to clean the inside of the main body 10.

A controller 160 may control the air conditioner 1 to perform the ventilation operation in response to the presence of an occupant not being detected in a state in which the cooling operation and the drying operation are not performed while the ventilation function is activated (or referred to as based on the ventilation function being activated).

The drying operation may be an operation mode for removing moisture inside the main body 10 (e.g., moisture around the heat exchanger 20).

The drying operation may also be referred to as 'microbial suppression operation' in that the drying operation suppresses the growth of microorganisms (e.g., mold) by removing moisture inside the air conditioner 1 (e.g., moisture around the heat exchanger 20).

The drying operation may also be referred to as 'operation at the termination of cooling operation' in that the drying operation is performed after the cooling operation of the air conditioner 1 is terminated.

The air conditioner 1 may perform the drying operation to remove moisture inside the main body 10.

The controller 160 may perform the drying operation in response to the termination of the cooling operation while the drying function is activated (or referred to as based on the drying function being activated).

In an embodiment, the ventilation operation and the drying operation may have in common that the ventilation operation and the drying operation drive the blower fan 32 without driving the compressor 3.

The controller 160 may control the air conditioner to perform the ventilation operation and the drying operation by driving the blower fan 32 without driving the compressor 3.

In an embodiment, the ventilation operation and the drying operation may have different motion algorithms.

For example, a rotation speed of the blower fan 32 in the drying operation and a rotation speed of the blower fan 32 in the ventilation operation may be different from each other.

As another example, the discharge port 41 may be open in the drying operation and closed in the ventilation operation.

As another example, in the drying operation, only the blower fan 32 may operate, and in the ventilation operation, the circular fan 37 may additionally operate in addition to the blower fan 32.

In the heating operation, the flow of refrigerant compressed by the compressor 3 may be controlled to allow indoor air to exchange heat with hot refrigerant of the heat exchanger 20.

The flow of refrigerant compressed by the compressor 3 may be changed by an operation of at least one valve (not shown) for changing the flow of refrigerant. For example, the controller 160 may control the air conditioner to perform the heating operation or the cooling operation by controlling the flow of refrigerant compressed by the compressor 3 by controlling the at least one valve.

In the cooling operation, the blower fan 32 may rotate while the compressor 3 operates. In the cooling operation, the flow of the refrigerant compressed by the compressor 3 may be controlled to allow the indoor air to exchange heat with the cold refrigerant of the heat exchanger 20. In the drying operation, only the blower fan 32 may rotate without the operation of the compressor 3. In an embodiment, even in the drying operation, the blower fan 32 may rotate while the compressor 3 operates. In the drying operation, the flow of the refrigerant compressed by the compressor 3 may be controlled to allow the indoor air to exchange heat with the hot refrigerant of the heat exchanger 20. That is, according to various embodiments, the drying operation may include the heating operation.

In the ventilation operation, only the blower fan 32 may rotate without the operation of the compressor 3. In the ventilation operation, the blower fan 32 and/or the circular fan 37 may rotate without the operation of the compressor 3.

The cooling operation may include a first cooling operation in which heat-exchanged air is discharged through the at least one discharge port 41, and a second cooling operation in which heat-exchanged air is discharged through the discharge hole 42 provided in a porous discharge plate 14. A size of the discharge port 41 may be greater than a size of the discharge hole 42. In addition, the number of discharge holes 42 may be larger than the number of discharge ports 41, and the discharge holes 42 may be distributed approximately uniformly throughout the discharge plate 14.

For example, in the first cooling operation, the air that is heat-exchanged may be discharged to the outside of the air conditioner 1 through the opened first discharge port 41*a*, second discharge port 41*b*, or third discharge port 41*c*. The air conditioner 1 may perform the first cooling operation by selectively opening the first discharge port 41*a*, the second discharge port 41*b*, or the third discharge port 41*c* according to the detected indoor temperature.

In the second cooling operation, the first discharge port 41*a*, the second discharge port 41*b*, and the third discharge port 41*c* may be all closed, and the heat-exchanged air may be discharged through the discharge hole 42 provided in the discharge plate 14.

For example, air that is heat-exchanged by the heat exchanger 20 may be discharged to the outside of the air conditioner through the at least one discharge port 41 and the discharge hole 42 by the blower fan 32.

In the first cooling operation, the heat-exchanged air may be discharged through the discharge port 41. Particularly, the heat-exchanged air may be discharged not only the discharge port 41 but also a portion of the heat-exchanged air may be discharged through the discharge hole 42. That is, in the first cooling operation, most of the heat-exchanged air may be discharged through the discharge port 41. In the second cooling operation, most of the heat-exchanged air may be discharged through the discharge hole 42, in the same manner as the first cooling operation.

Air passing through the blowing portion 30 may be discharged to the outside of the main body 10 through the discharge port 41.

When the air conditioner 1 performs the first cooling operation, the heat-exchanged air may be discharged to the outside of the main body 10 through the discharge port 41. The discharge port 41 may be provided to allow the heat-exchanged air to be directly discharged to the outside. The discharge port 41 may be provided to be exposed to the outside of the main body 10. The discharge port 41 may be provided in the blowing direction of the blower fan 32 to allow the heat-exchanged air to be directly discharged to the outside. The air blown by the blower fan 32 may flow through a first discharge flow path 41*d* formed between the blower fan 32 and the discharge port 41. The first discharge flow path 41*d* may be formed by a discharge guide 45.

The first discharge flow path 41*d* may be formed by the discharge guide 45. An end 43 of the discharge guide 45 may be connected to the discharge port 41, and the first discharge flow path 41*d* may be formed along an inner circumferential surface of the discharge guide 45.

The end 43 of the discharge guide 45 may be exposed to the outside through the discharge port 41 of the main body 10, and the discharge guide 45 may be seated on the end 43 of the discharge guide 45 as a door 60 described in greater detail below is moved.

The discharge port 41 may be opened and closed by the door 60.

The door 60 may open and close the discharge port 41, and heat-exchanged air may be selectively discharged to the outside of the main body 10 through the discharge port 41. For example, the door 60 may include a first door 60*a* configured to open and close the first discharge port 41*a*, a second door 60*b* configured to open and close the second discharge port 41*b*, and a third door 60*c* configured to open and close the third discharge port 41*c*.

The door 60 may move between an open position P1 that opens the discharge port 41 and a closed position P2 that closes the discharge port 41. The door 60 may move in the front and rear directions between the open position P1 and the closed position P2.

For example, each door 60 may include a door blade 62 and the door actuator 66 configured to operate the door blade 62.

The door blade 62 may be formed in a circular shape corresponding to the shape of the discharge port 41. When the door 60 is in the open position P1, the door blade 62 may be spaced apart from the end 43 of the discharge guide 45, and when the door 60 is in the closed position P2, the door blade 62 may be in contact with the end 43 of the discharge guide 45 to close the discharge port 41. For example, the door blade 62 may include a first door blade 62*a* configured to open and close the first discharge port 41*a*, a second door blade 62*b* configured to open and close the second discharge port 41*b*, and a third door blade 62*c* configured to open and close the third discharge port 41*c*.

The door blade 62 may include a blade body 63 formed in a circular shape to correspond to the discharge port 41, and a blade coupling portion 64 provided to extend from the blade body 63 and coupled to the door actuator 66.

The blade body 63 may be provided in a substantially circular plate shape. In addition, the blade body 63 may be provided to allow one side surface thereof to face the outside of the main body 10 and to allow the other side surface thereof to face the discharge port 41.

The display may be provided on one side surface of the blade body 63, and the display may be provided to display an operating status of the air conditioner or to manipulate the air conditioner.

The door actuator 66 may move the door blade 62. The door actuator 66 may include a motor (not shown). The door actuator 66 may be coupled to the blade coupling portion 64 of the door blade 62 to move the door blade 62.

For example, the door actuator 66 may include a first door actuator 66*a* configured to move the first door blade 62*a*, a second door actuator 66*b* configured to move the second door blade 62*b*, and a third door actuator 66*c* configured to move the third door blade 62*c*.

The above-mentioned grille 34 may be arranged around the door actuator 66. Air blown from the blower fan 32 provided on the rear surface of the grille 34 may be discharged forward by passing through the grille 34.

When the air conditioner 1 performs the second cooling operation, the heat-exchanged air may be discharged to the outside of the main body 10 through the discharge hole 42. With the configuration, the heat-exchanged air may be discharged to the outside while reducing a wind speed. The discharge hole 42 may include the plurality of discharge holes 42 formed in the porous discharge plate 14 described in greater detail below.

When the heat-exchanged air is discharged to the outside of the main body 10 through the discharge hole 42, the air blown by the blower fan 32 may flow through a second discharge flow path 42*a* formed between the blower fan 32 and the discharge hole 42. The second discharge flow path 42*a* may be formed by the discharge guide 45 and a discharge panel 12 described in greater detail below.

The discharge panel 12 may form the second discharge flow path 42*a*. The heat-exchanged air may be discharged to the outside of the air conditioner at a low speed through the second discharge flow path 42*a* formed by the discharge panel 12 and the discharge plate 14 described in greater detail below.

The discharge panel 12 may include a flow path forming frame 13 and the discharge plate 14.

The flow path forming frame 13 may define the inside of the main body 10 and the second discharge flow path 42*a*. The flow path forming frame 13 may prevent and/or reduce heat-exchanged air from flowing back into the inside of the main body 10. In an embodiment, the flow path forming frame 13 may be formed to extend from the grille 34 and be connected to an outer panel 11.

The discharge hole 42 may be formed on the discharge plate 14. The shape of the discharge hole 42 is not limited thereto, but according to an embodiment of the present disclosure, the discharge hole 42 may have a plurality of shapes. The discharge hole 42 may penetrate front and rear surfaces of the discharge plate 14.

The discharge hole 42 may form a discharge region. The plurality of discharge holes 42 may be uniformly distributed in the discharge region, and may be concentrated in at least a portion. In an embodiment, the plurality of discharge holes 42 may be provided to be uniformly distributed in the discharge region.

The discharge region may be formed on at least a portion of the discharge plate 14. However, the present disclosure is not limited thereto, and air may be discharged through the entire surface of the discharge plate 14.

The discharge portion 40 may include the first discharge flow path 41*d* and the second discharge flow path 42*a*.

Air blown by the blower fan 32 may flow through at least one of the first discharge flow path 41*d* and the second discharge flow path 42*a*.

In the first cooling operation, air blown by the blower fan 32 may flow through the first discharge flow path 41*d* formed between the blower fan 32 and the discharge port 41. In addition, in the second cooling operation, air blown by the blower fan 32 may flow through the second discharge flow path 42*a* formed between the blower fan 32 and the discharge hole 42.

The first cooling operation may be referred to as 'general air operation' in that air blown by the blower fan 32 is directly discharged to the discharge port 41.

The second cooling operation may be referred to as 'windless operation' in that air blown by the blower fan 32 is discharged through the discharge hole 42 without being directly discharged through the discharge port 41.

The discharge portion 40 may include the discharge guide 45. Air blown by the blower fan 32 may be controlled by the discharge guide 45. The discharge guide 45 may be provided in front of the blowing portion 30 so as to allow air flowing from the blowing portion 30 to flow through at least one discharge flow path of the first discharge flow path 41*d* and the second discharge flow path 42*a*.

The discharge guide 45 may include a guide body 46 and a guide groove 47.

The guide body 46 may form the first discharge flow path 41*d* on an inner side thereof. The guide body 46 may be provided in a cylindrical shape including a hollow portion. Particularly, the guide body 46 may be provided in a tube shape, and one side thereof may face the blowing portion 30 and the other side thereof may face the discharge port 41.

The guide groove 47 is formed to allow the second discharge flow path 42*a* to pass therethrough. The guide groove 47 may be provided on the guide body 46. A shape of the guide groove 47 is not limited thereto, and it is sufficient that the guide groove 47 is formed on the guide body 46 so as to allow air to flow in an outward direction of the guide body 46. In an embodiment, the guide groove 47 may have a plurality of hole shapes along a circumference of the guide body 46.

In the first cooling operation, the door 60 opens the discharge port 41. In this case, air blown from the blowing portion 30 is discharged through the discharge port 41 by passing through the first discharge flow path 41*d* formed on the inside of the guide body 46.

In the second cooling operation, the door 60 closes the discharge port 41. In this case, one side of the guide body 46 is blocked by the door 60, and thus air blown from the blowing portion 30 is discharged through the discharge hole 42 by passing through the guide groove 47 formed in the guide body 46.

Hereinafter an example of the operation of the air conditioner 1 of the present disclosure will be described.

Air introduced from the outside to the main body 10 may exchange heat with the heat exchanger 20. The air that is heated or cooled by the heat exchanger 20 is discharged to the outside of the main body 10 by the blowing portion 30.

The air conditioner 1 discharges air, which passes through the heat exchanger 20, to the outside through at least one of the discharge port 41 and the discharge hole 42. For example, the air conditioner 1 may quickly achieve heating or cooling by discharging air through the discharge port 41 as in the first cooling operation, and the air conditioner 1 may slowly achieve heating or cooling throughout the room by discharging air through the discharge hole 42 as in the second cooling operation.

The discharge port 41 may be opened and closed by the operation of the door 60. When the discharge port 41 is opened, the heat-exchanged air may be discharged through the discharge port 41, and when the discharge port 41 is closed, the heat-exchanged air may be discharged through the discharge hole 42.

In the first cooling operation, heat-exchanged air is discharged through the discharge port 41. When the door blade 62 is positioned in the open position P1 in the first cooling operation, the door blade 62 may be spaced apart from the end 43 of the discharge guide 45 and thus the discharge port 41 may be opened.

In this case, air blown from the blowing portion 30 flows to the discharge port 41 through the first discharge flow path 41*d* formed by the guide body 46 of the discharge guide 45.

When air is discharged to the outside of the main body 10 through the discharge port 41, the air is discharged to the outside while maintaining a wind speed by the blowing portion 30.

In the second cooling operation, the heat-exchanged air is discharged through the discharge hole 42. When the door blade 62 is positioned in the closed position P2 in the second cooling operation, the door blade 62 may come into contact with the end 43 of the discharge guide 45 and thus the discharge port 41 may be closed.

In this case, air blown from the blowing portion 30 passes through the guide groove 47 formed in the guide body 46 of the discharge guide 45 because the discharge port 41 is blocked by the door blade 62. Accordingly, air blown from the blowing portion 30 passes through the second discharge flow path 42*a* and flows into the discharge hole 42.

When air is discharged to the outside of the main body 10 through the discharge hole 42, a wind speed of the air is reduced while passing through the plurality of discharge holes of the discharge plate 14, and thus the air is discharged to the outside at a low speed.

The configuration allows a user to cool or heat the room at a comfortable air speed.

In the drying operation, air may be discharged to the outside of the air conditioner 1 through the opened first discharge port 41*a*, second discharge port 41*b* or third discharge port 41*c*, or may be discharged through the discharge hole 42 provided in the discharge plate 14 in a state in which the first discharge port 41*a*, the second discharge port 41*b* and the third discharge port 41*c* are closed.

In the present disclosure, the discharge portion provided in the main body 10 may be a concept including at least one of the discharge port 41 and the discharge hole 42.

Figure 9:
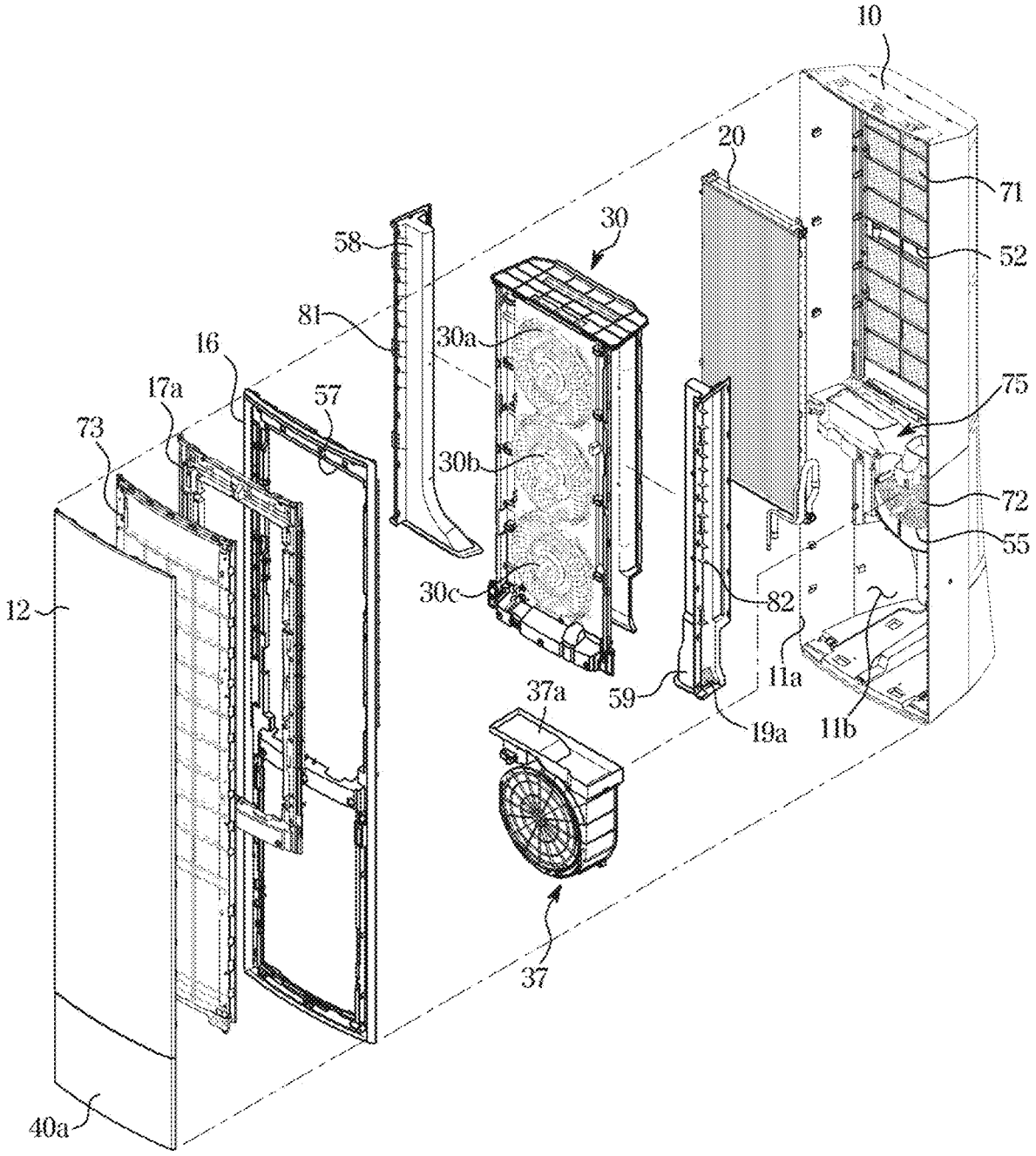
FIG. 9 is an exploded perspective view illustrating an example air conditioner according to various embodiments.

Meanwhile, a method of controlling the air conditioner according to the present disclosure may be implemented in the air conditioner 1 in which the discharge port 41 is opened and closed by the door 60 and the heat-exchanged air is selectively discharged to the outside of the main body 10 through the discharge port 41, as described in the above-described FIGS. 4 to 8, or in an air conditioner 1 in which a discharge port 41 is not provided in a discharge panel 12 but a plurality of holes having a fine size is uniformly distributed on the discharge panel 12 and thus the heat-exchanged air is discharged at a low speed, as described in greater detail below with reference to FIG. 9.

Figure 10:
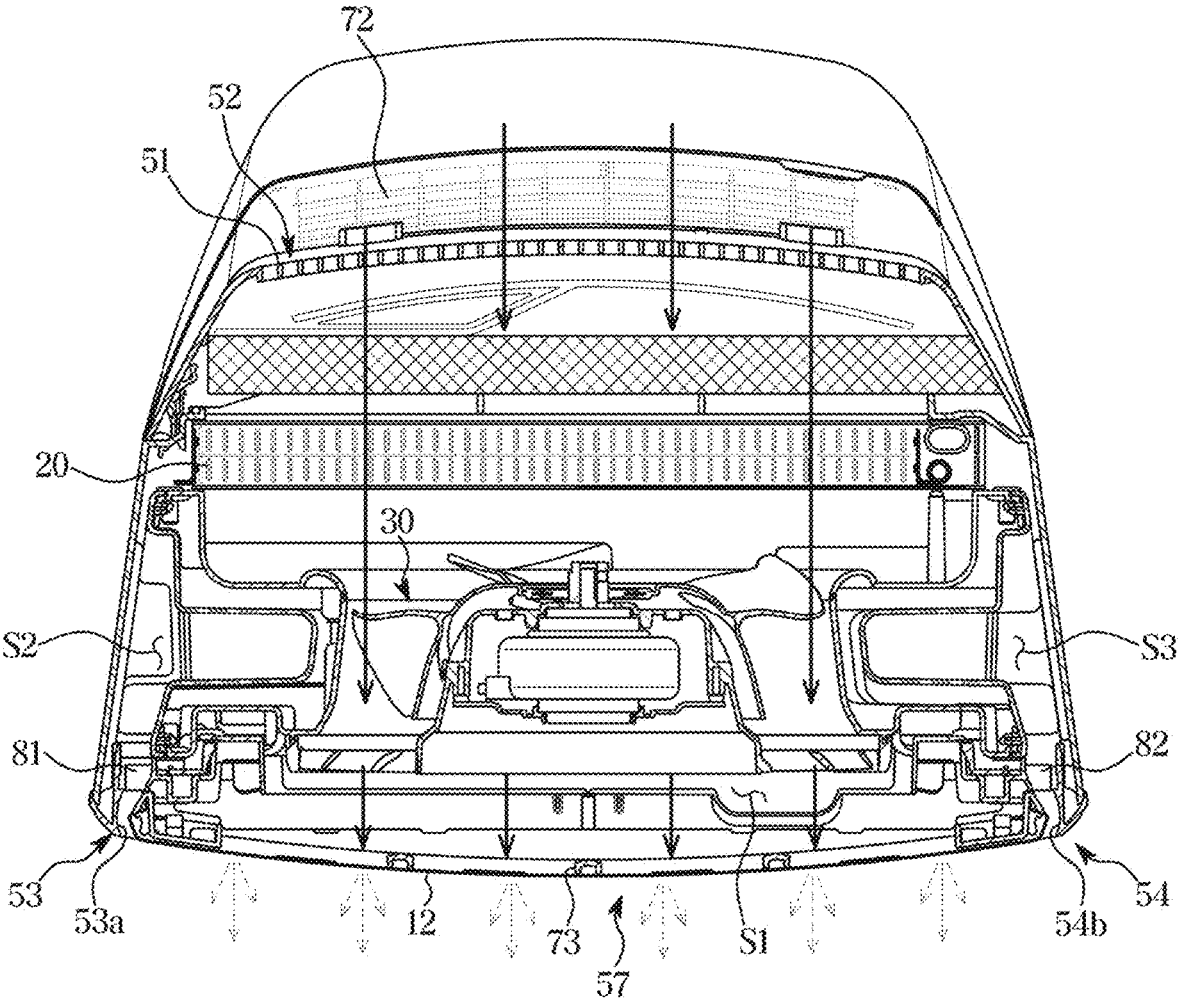
FIG. 10 is a cross-sectional view illustrating a state in which the air condition of FIG. 9 blows air to a first flow path according to various embodiments.
Figure 11:
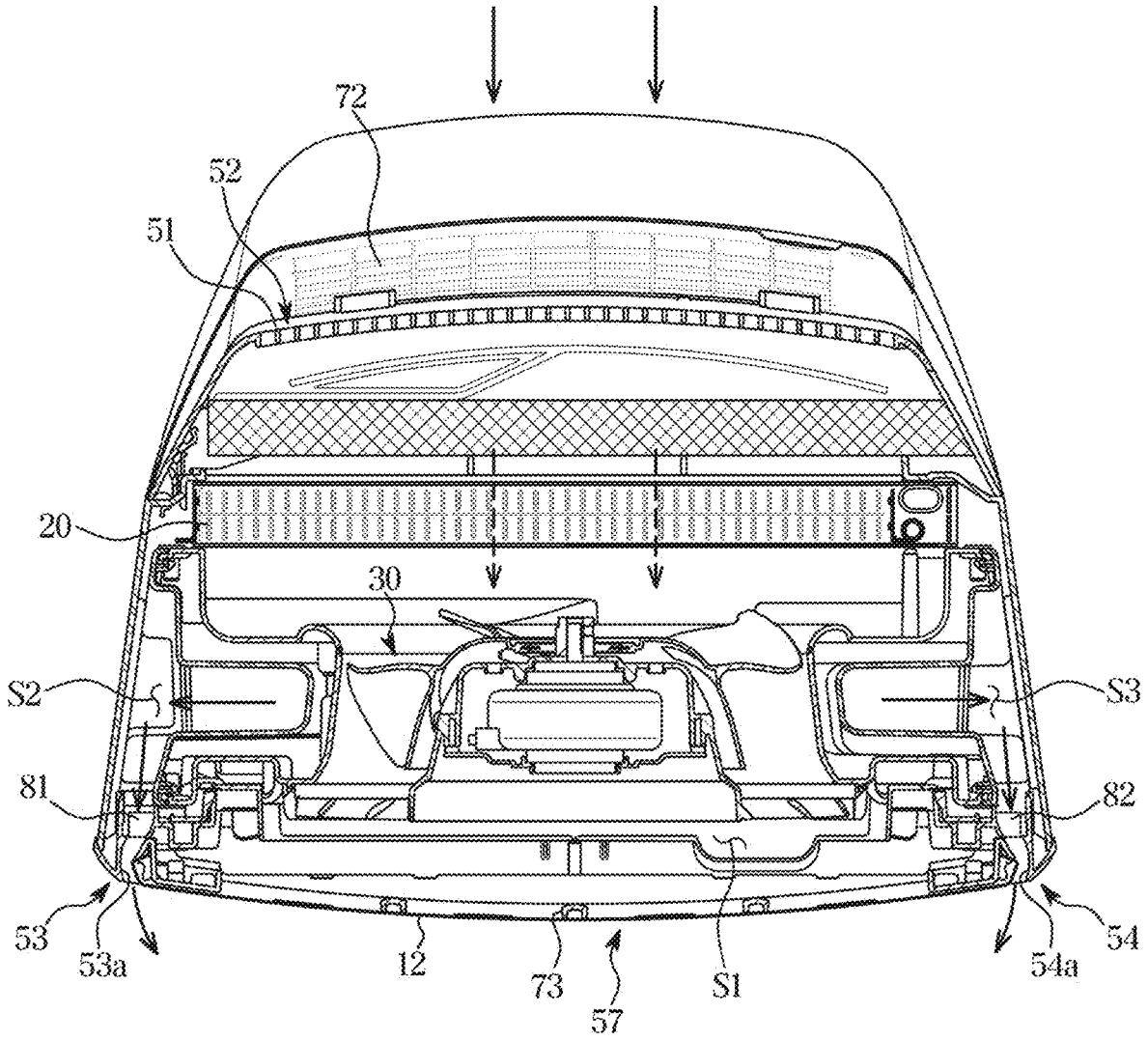
FIG. 11 is a cross-sectional view illustrating a state in which the air condition of FIG. 9 blows air to a second flow path and a third flow path according to various embodiments.

FIG. 9 is an exploded perspective view of an example of an air conditioner according to various embodiments. FIG. 10 is a cross-sectional view illustrating a state in which the air condition of FIG. 9 blows air to a first flow path according to various embodiments. FIG. 11 is a cross-sectional view illustrating a state in which the air condition of FIG. 9 blows air to a second flow path and a third flow path according to various embodiments.

Referring to FIGS. 9, 10 and 11 (which may be referred to as FIGS. 9 to 11), an air conditioner 1 may include a main body 10 forming an appearance, a blowing portion 30 configured to circulate air into or out of the main body 10, and a heat exchanger 20 configured to exchange heat with air flowing into the inside of the main body 10.

The main body 10 may be coupled to a front panel 16, provided to cover a front surface of the main body 10, to which the blowing portion 30 and the heat exchanger 20 are mounted. The main body 10 may include a first inlet 52, a second inlet 55, a main outlet 57, and guide outlets 53 and 54.

The main body 10 may form a rear surface, both side surfaces, an upper surface, and a lower surface of the air conditioner 1. The front surface of the main body 10 may be opened and the open front surface may form a body case opening 11*a*. The body case opening 11*a* may be covered by the front panel 16 and a discharge panel 12.

The front panel 16 may be coupled to the body case opening 11*a*. FIG. 9 illustrates that the front panel 16 is provided to be detachable from the main body 10, but the front panel 16 and the main body 10 may be formed integrally.

The main outlet 57 may be formed on the front panel 16. The main outlet 57 may be arranged on the front surface of the main body 10. The main outlet 57 may penetrate the front panel 16. The main outlet 57 may be formed on an upper portion of the front panel 16. The main outlet 57 may be arranged at a position approximately facing the first inlet 52. Air that is heat-exchanged inside the main body 10 may be discharged to the outside of the main body 10 through the main outlet 57. The main outlet 57 may discharge air that is introduced through the first inlet 52.

A panel support member 17*a* provided to support the discharge panel 12 may be formed on a portion of the front panel 16 in which the main outlet 57 is formed. The panel support member 17*a* may extend along a circumference of the main outlet 57. The panel support member 17*a* may support a rear surface of the discharge panel 12.

The first inlet 52 may be formed on the main body 10. The first inlet 52 may penetrate the rear surface of the main body 10. The first inlet 52 may be formed in the upper portion of the rear surface of the main body 10. Outside air may be introduced into the inside of the main body 10 through the first inlet 52.

FIG. 9 illustrates that two first inlets 52 are provided, but the number of first inlets 52 is not limited thereto and may be provided in various ways as needed. Although FIG. 9 illustrates that the first inlet 52 is formed in a square shape, the shape of the first inlet 52 is not limited thereto and may be formed in various ways as needed.

The second inlet 55 may be formed on the main body 10. The second inlet 55 may penetrate the rear surface of the main body 10. The second inlet 55 may be formed in a lower portion of the rear surface of the main body 10. The second inlet 55 may be formed at the lower side of the first inlet 52. Outside air may be introduced into the inside of the main body 10 through the second inlet 55.

In the same manner as the first inlet 52, the number and/or shape of the second inlet 55 may vary as needed.

The front panel 16 may form the guide outlets 53 and 54 together with the discharge panel 12. The guide outlets 53 and 54 may be formed on the same surface as the main outlet 57. The guide outlets 53 and 54 may be formed on the left and/or right side of the main outlet 57. The guide outlets 53 and 54 may be arranged adjacent to the main outlet 57. The guide outlets 53 and 54 may be arranged at a predetermined distance from the main outlet 57. The guide outlets 53 and 54 may include a first guide outlet 53 arranged on the left side of the main outlet 57, and a second guide outlet 54 arranged on the right side of the main outlet 57.

The guide outlets 53 and 54 may extend along the vertical direction of the main body 10. The guide outlets 53 and 54 may have a length approximately equal to a length of the main outlet 57. Air that is not heat-exchanged inside the main body 10 may be discharged to the outside of the main body 10 through the guide outlets 53 and 54. The guide outlets 53 and 54 may be provided to discharge air that is introduced through the second inlet 55.

The guide outlets 53 and 54 may be configured to mix air discharged from the guide outlets 53 and 54 with air discharged from the main outlet 57. Particularly, a portion of the front panel 16 forming the guide outlets 53 and 54 may include guide curved portions 53*a* and 54*a* provided to guide air discharged from the guide outlets 53 and 54 to allow the air discharged from the guide outlets 53 and 54 to be mixed with air discharged from the main outlet 57.

Air discharged through the guide outlet 53 and 54 may be discharged in a direction in which the air is mixed with air discharged from the main outlet 57, along the guide curved portions 53*a* and 54*a*. The guide curved portions 53*a* and 54*a* may guide the air discharged through the guide outlet 53 and 54 to be discharged in approximately the same direction as the air discharged through the main outlet 57. The guide curved portions 53*a* and 54*a* may be provided to guide the air discharged through the guide outlet 53 and 54 forward.

Blades 81 and 82 provided to guide air discharged through the guide outlets 53 and 54 may be disposed in the guide outlets 53 and 54. The blades 81 and 82 may be arranged sequentially along a length direction of the guide outlets 53 and 54. A first blade 81 may be disposed on the first guide outlet 53, and a second blade 82 may be disposed on the second guide outlet 54.

An air flow path connecting the first inlet 52 and the main outlet 57 is defined as a first flow path S1, an air flow path connecting the second inlet 55 and the first guide outlet 53 is defined as a second flow path S2, and an air flow path connecting the second inlet 55 and the second guide outlet 54 is defined as a third flow path S3. The first flow path S1 may be partitioned from the second flow path S2 and the third flow path S3. Accordingly, air flowing through the first flow path S1 may not be mixed with air flowing through the second flow path S2 and the third flow path S3. The second flow path S2 and the third flow path S3 may be overlapped in some sections. For example, on the second flow path S2 and the third flow path S3, a section from the second inlet 55 to a circular fan 37 may be overlapped.

A first duct 58 provided to define the first flow path S1 and the second flow path S2 may be disposed in the main body 10. The first duct 58 may be disposed on the left side of the blowing portion 30. The first duct 58 may extend in the vertical direction. The first duct 58 may communicate with the circular fan 37. The first duct 58 may communicate with a fan discharge port 37*a* of the circular fan 37. The first duct 58 may guide a portion of the air blown by the circular fan 37 to the first guide outlet 53. A first duct filter (not shown) may be disposed in the first duct 58 to filter out foreign substances in the air introduced from the circular fan 37.

A second duct 59 provided to define the first flow path S1 and the third flow path S3 may be disposed in the main body 10. The second duct 59 may be arranged on the right side of the blowing portion 30. The second duct 59 may extend in the vertical direction. The second duct 59 may communicate with the circular fan 37. The second duct 59 may communicate with the fan discharge port 37*a* of the circular fan 37. The second duct 59 may guide a portion of the air blown by the circular fan 37 to the second guide outlet 54. A second duct filter 19*a* may be disposed in the second duct 59 to filter out foreign substances in the air introduced from the circular fan 37.

The air conditioner 1 may discharge air, which exchanges heat with the heat exchanger 20, through the main outlet 57 and discharge air, which does not pass through the heat exchanger 20, through the guide outlets 53 and 54. For example, the guide outlets 53 and 54 may be provided to discharge air that is not heat-exchanged. Because the heat exchanger 20 is arranged on the first flow path S1, the air discharged through the main outlet 57 may be heat-exchanged air. Because the heat exchanger is not arranged on the second flow path S2 and the third flow path S3, the air discharged through the guide outlets 53 and 54 may be air that is not heat-exchanged.

In an embodiment, the heat-exchanged air may be discharged through the guide outlets 53 and 54. That is, a heat exchanger may also be arranged on the second flow path S2 and the third flow path S3. For example, a heat exchanger for heat-exchanging air discharged through the guide outlets 53 and 54 may be arranged in the accommodating space 11*b* of the main body 10. With the configuration, the air conditioner 1 may provide the heat-exchanged air through both the main outlet 57 and the guide outlets 53 and 54.

The accommodating space 11*b*, in which electrical components (not shown) are disposed, may be formed inside the main body 10. The electrical components required for operating the air conditioner 1 may be disposed in the accommodating space 11*b*. The circular fan 37 may be disposed in the accommodating space 11*b*.

The circular fan 37 may be configured to be driven independently of the blowing portion 30. A rotation speed of the circular fan 37 may be different from a rotation speed of the blowing portion 30.

The blowing portion 30 may be disposed on the first flow path S1 formed between the first inlet 52 and the main outlet 57. Air may be introduced into the inside of the main body 10 through the first inlet 52 by the blowing portion 30. The air introduced through the first inlet 52 may move along the first flow path S1 and be discharged to the outside of the main body 10 through the main outlet 57.

An axial fan or a diagonal fan may be applied to the blowing portion 30. However, the type of the blowing portion 30 is not limited thereto, and it is sufficient that the blowing portion 30 is configured to allow air, which is introduced from the outside of the main body 10, to be discharged back to the outside of the main body 10. For example, the blowing portion 30 may be a cross fan, a turbo fan, or a sirocco fan.

FIG. 9 illustrates that the number of fans in the blowing portion 30 is three, but the number of fans in the blowing portion 30 is not limited thereto and may be provided in various numbers as needed.

According to an embodiment, the blowing portion 30 may include at least one blower fan modules 30*a*, 30*b* and 30*c*.

The at least one blower fan module 30*a*, 30*b* and 30*c* may correspond to the blower fan 32 and the fan motor 33 described above with reference to FIG. 4. For example, a first blower fan module 30*a* may include a first blower fan 32*a* and a first fan motor 33*a* configured to drive the first blower fan 32*a*. A second blower fan module 30*b* may include a second blower fan 32*b* and a second fan motor 33*b* configured to drive the second blower fan 32*b*. A third blower fan module 30*c* may include a third blower fan 32*c* and a third fan motor 33*c* configured to drive the third blower fan 32*c*.

The circular fan 37 may be disposed on the second flow path S2 and the third flow path S3 formed between the second inlet 55 and the guide outlets 53 and 54. The circular fan 37 may correspond to the circular fan 37 described above with reference to FIG. 4.

By the circular fan 37, air may be introduced into the inside of the main body 10 through the second inlet 55. A portion of the air introduced through the second inlet 55 may move along the second flow path S2 and be discharged to the outside of the main body 10 through the first guide outlet 53, or may move along the third flow path S3 and be discharged to the outside of the main body 10 through the second guide outlet 54. The circular fan 37 may be implemented as a circulator according to an embodiment.

The heat exchanger 20 may be arranged between the blowing portion 30 and the first inlet 52. The heat exchanger 20 may be arranged on the first flow path S1. The heat exchanger 20 may absorb heat from air introduced through the first inlet 52 or transfer heat to air introduced through the first inlet 52. The heat exchanger 20 may include a tube and a header coupled to the tube. However, the type of the heat exchanger 20 is not limited thereto.

The air conditioner 1 may include the discharge panel 12 arranged on a portion of the front panel 16 in which the main outlet 57 is formed. For example, the discharge panel 12 may be coupled to the main body 10 through the front panel 16. The discharge panel 12 may include a plurality of holes provided to allow air discharged from the main outlet 57 to be discharged more slowly than air discharged from the guide outlets 53 and 54. The plurality of holes may penetrate inner and outer surfaces of the discharge panel 12. The plurality of holes may be formed in a fine size. The plurality of holes may be uniformly distributed over the entire area of the discharge panel 12. The heat-exchanged air discharged through the main outlet 57 may be uniformly discharged at a low speed by the plurality of holes. A blocking portion 40*a*, in which the plurality of holes is not formed, may be provided at the lower end portion of the discharge panel 12.

In an embodiment, the air conditioner 1 may not include the discharge panel 12, and the heat-exchanged air may be discharged to an air conditioning space through the main outlet 57. The main outlet 57 is provided to allow the heat-exchanged air to be directly discharged to the outside (air conditioning space). That is, the main outlet 57 may be provided to be exposed to the outside of the main body 10. In this case, air introduced into the first inlet 52 may be discharged to the room (air conditioning space) through the main outlet 57 after being heat-exchanged in the heat exchanger 20. In other words, when the air conditioner 1 does not include the discharge panel 12, the air may be discharged to the outside through the main outlet 57 without a speed reduction by the discharge panel 12. According to various embodiments, the air conditioner 1 may or may not include components forming the guide flow paths S2 and S3, such as the second inlet 55, the circular fan 37, a distribution device 75, the first duct 58, the second duct 59, and the guide outlets 53 and 54.

The air conditioner 1 may include a first intake grille 71 coupled to a portion of the main body 10 in which the first inlet 52 is formed. The first intake grille 71 may be provided to prevent and/or reduce foreign substances from entering through the first inlet 52. For this, the first intake grille 71 may include a plurality of slits or holes. The first intake grille 71 may be provided to cover the first inlet 52.

The air conditioner 1 may include a second intake grille 72 coupled to a portion of the main body 10 in which the second inlet 55 is formed. The second intake grille 72 may be provided to prevent and/or reduce foreign substances from entering through the second inlet 55. For this, the second intake grille 72 may include a plurality of slits or holes. The second intake grille 72 may be provided to cover the second inlet 55.

The air conditioner 1 may include a discharge grille 73 coupled to a portion of the front panel 16 in which the main outlet 57 is formed. The discharge grille 73 may be mounted on the panel support member 17*a*. The discharge grille 73 may be provided to prevent and/or reduce foreign substances from being discharged through the main outlet 57. For this, the discharge grille 73 may include a plurality of slits or holes. The discharge grille 73 may be provided to cover the main outlet 57.

The air conditioner 1 may include the distribution device 75. The distribution device 75 may be disposed inside the main body 10. The distribution device 75 may be disposed in the accommodating space 11*b* of the main body 10. The distribution device 75 may be disposed adjacent to the fan discharge port 37*a* of the circular fan 37. The distribution device 75 may be disposed at a portion in which air introduced from the second inlet 55 branches off to the first guide outlet 53 and the second guide outlet 54. The distribution device 75 may be disposed between the first inlet 52 and the second inlet 55. The distribution device 75 may be configured to distribute air blown by the circular fan 37 to the first duct 58 and the second duct 59. The distribution device 75 may be configured to control a flow rate of air discharged through the first guide outlet 53 and the second guide outlet 54.

Referring to FIG. 10, the air conditioner 1 may be operated in a first mode that discharges heat-exchanged air only through the main outlet 57. Because the discharge panel 12 is arranged in the main outlet 57, the air conditioning may be slowly performed throughout the room. For example, when the air is discharged to the outside of the main body 10 through the main outlet 57, a wind speed of the air may be reduced while passing through the plurality of discharge holes of the discharge panel 12, and thus the air may be discharged to the outside at a low speed. The configuration allows a user to cool or heat the room at a comfortable air speed.

For example, as the blowing portion 30 is driven, the outside air of the main body 10 may be introduced into the inside of the main body 10 through the first inlet 52. The air introduced into the inside of the main body 10 may be heat-exchanged while passing through the heat exchanger 20. The air that is heat-exchanged by passing through the heat exchanger 20 may have a reduced speed while passing through the blowing portion 30 and the discharge panel 12, and then be discharged to the outside of the main body 10 through the main outlet 57. For example, the heat-exchanged air that is discharged while passing through the first flow path S1 may be discharged at a wind speed that makes a user feel comfortable.

Because the circular fan 37 is not driven in the first mode, air is not discharged through the guide outlet 53 and 54.

Referring to FIG. 11, the air conditioner 1 may be operated in a second mode in which non-heat-exchanged air is discharged only through the guide outlets 53 and 54. Because the heat exchanger 20 is not arranged on the second flow path S2 and the third flow path S3, the air conditioner 1 may circulate indoor air.

Because the guide outlets 53 and 54 are provided with the guide curved portions 53*a* and 54*a*, air discharged through the guide outlets 53 and 54 may be discharged toward the front of the air conditioner 1. Because the blades 81 and 82 are provided on the guide outlets 53 and 54, air may be blown further to the front.

For example, as the circular fan 37 is driven, the outside air of the main body 10 may be introduced into the inside of the main body 10 through the second inlet 55. The air introduced into the inside of the main body 10 may pass through the circular fan 37 and then move to the second flow path S2 and the third flow path S3 formed on both sides of the first flow path S1. The air may move upward on the second flow path S2 and the third flow path S3 and then be discharged to the outside of the main body 10 through the guide outlets 53 and 54. The air may be guided to the front of the air conditioner 1 along the guide curved portions 53*a* and 54*a*.

Because the blowing portion 30 is not driven in the second mode, air is not discharged through the main outlet 57. For example, in the second mode, the air conditioner 1 blows air that is not heat-exchanged, and thus the air conditioner 1 may simply perform the function of circulating indoor air or provide strong wind to a user.

In addition, the air conditioner 1 may be operated in a third mode in which heat-exchanged air is discharged through the main outlet 57 and the guide outlets 53 and 54. The air conditioner 1 may discharge cold air further when operated in the third mode than when operated in the first mode.

For example, when the air conditioner 1 is driven in the third mode, cold or warm air discharged through the main outlet 57 and air discharged through the guide outlets 53 and 54 may be mixed. In addition, because the air discharged through the guide outlets 53 and 54 is discharged at a faster speed than the air discharged through the main outlet 57, the air discharged through the guide outlets 53 and 54 may move the heat-exchanged air, which is discharged through the main outlet 57, further away.

With the configuration, the air conditioner 1 may provide a user with comfortable cold or warm air in which heat-exchanged air and indoor air are mixed.

The air conditioner 1 according to an embodiment may be driven in any one of the first mode, the second mode, or the third mode when performing the cooling operation in which the refrigerant evaporates in the heat exchanger 20. For example, when performing the cooling operation, the air conditioner 1 may be driven in any one of the first mode in which heat-exchanged air is discharged only through the first flow path S1, the second mode in which air is discharged only through the guide flow paths S2 and S3, and the third mode in which air is discharged through both the first flow path S1 and the guide flow paths S2 and S3.

In the cooling operation, the heat exchanger 20 may be cooled by the refrigerant, and when air drawn through the first inlet 52 comes into contact with the cooled heat exchanger 20, moisture may be condensed on a surface of the heat exchanger 20. Because the blowing portion 30 blows air during the cooling operation, moisture condensed on the surface of the heat exchanger 20 may be collected in a drain container provided under the heat exchanger 20 by the blown air.

When the blowing portion 30 is stopped after the termination of the cooling operation, moisture condensed on the heat exchanger 20 may not be removed. Moisture condensed on the first inlet 52, the main outlet 57, and the discharge panel 12 as well as the heat exchanger 20 may not be removed. Due to the moisture, microorganisms may multiply in the heat exchanger 20, the first inlet 52, the main outlet 57, and the discharge panel 12, which may cause stains and odors.

Figure 12:
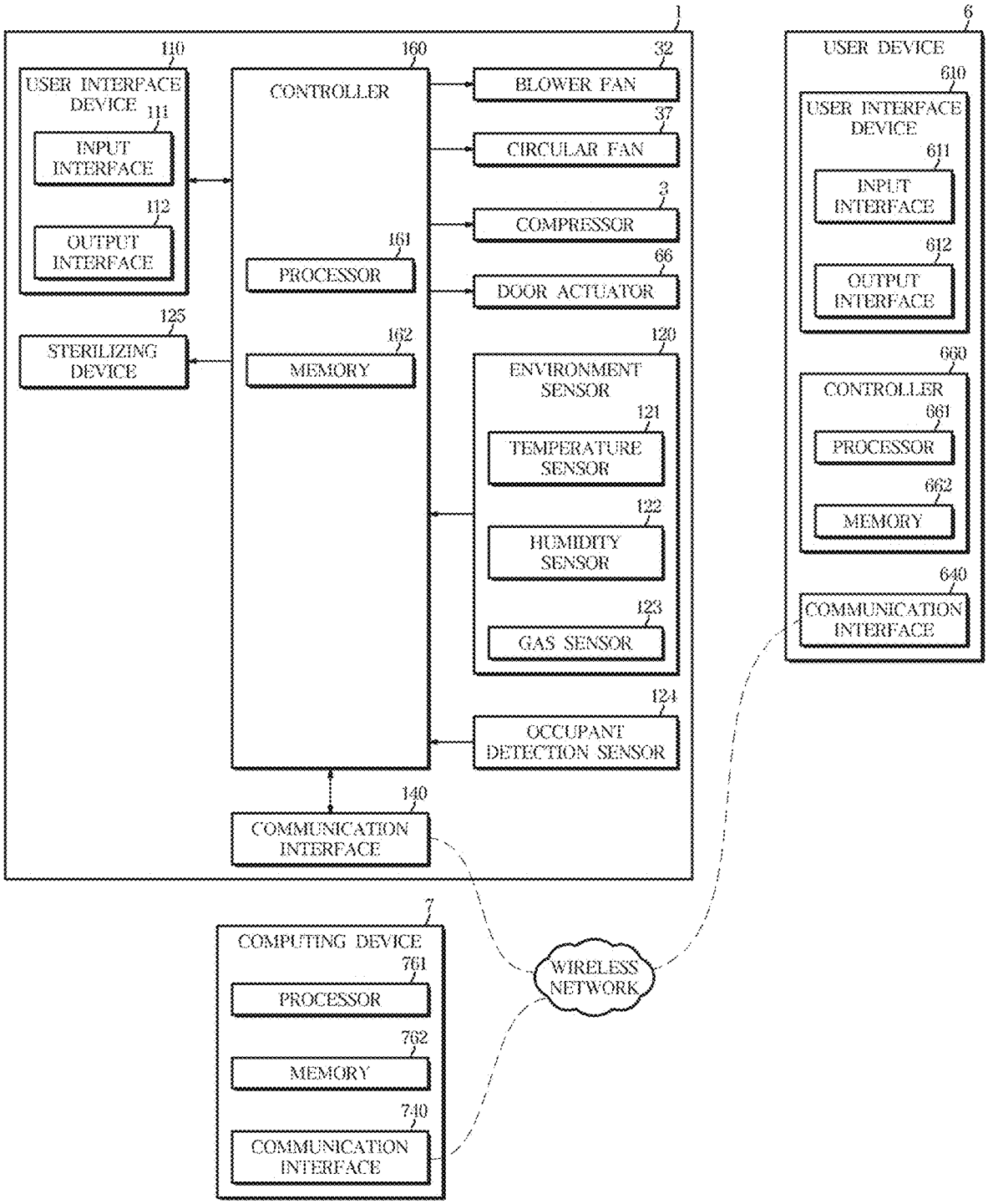
FIG. 12 is a block diagram illustrating an example configuration of the air conditioner control system according various embodiments.

FIG. 12 is a block diagram illustrating an example configuration of the air conditioner control system according to various embodiments.

Referring to FIG. 12, the air conditioner 1 according to an embodiment may include a user interface device (e.g., including interface circuitry) 110, an environmental sensor 120, the compressor 3, the blower fan 32, the circular fan 37, an occupant detection sensor 124, a sterilizing device 125, a communication interface (e.g., including communication circuitry) 140, and/or the controller (e.g., including processing circuitry and a memory) 160.

The user interface device 110 may include various interface circuitry and allow a user and the air conditioner 1 to interact with each other.

The user interface device 110 may include an output interface 112 and an input interface 111.

At least one output interface 112 may transmit various information related to the operation of the air conditioner 1 to a user by generating sensory information.

For example, the at least one output interface 112 may transmit information related to settings of the air conditioner 1 and an operating time of the air conditioner 1 to a user. Information related to the operation of the air conditioner 1 may be output through a display, an indicator, and/or a voice. The at least one output interface 112 may include a Liquid Crystal Display (LCD) panel, an indicator, a Light Emitting Diode (LED) panel, a speaker, etc.

The at least one input interface 111 may convert sensory information received from a user into an electrical signal.

The at least one input interface 111 may include a power button for turning on the air conditioner 1, a setting button for setting an operation mode of the air conditioner 1, a control button for controlling a rotation speed of the compressor 3 and/or the blower fan 32, and/or a timer button.

Each button may include a visual indicator (e.g. text, icon, etc.) provided to indicate a function thereof.

The at least one input interface 111 may include a tact switch, a push switch, a slide switch, a toggle switch, a micro switch, a touch switch, a touch pad, a touch screen, a jog dial, and/or a microphone, etc.

In the present disclosure, a 'button' may be replaced by a User Interface (UI) element, a tact switch, a push switch, a slide switch, a toggle switch, a micro switch, a touch switch, a touch pad, a touch screen, a jog dial, and/or a microphone.

The power button is a button to turn on or off power of the air conditioner 1.

The setting button is a button to change the operation mode of the air conditioner 1. The operation mode of the air conditioner 1 may include the cooling operation, the heating operation, the drying operation, etc.

An operating frequency of the compressor 3 and the rotation speed of the blower fan 32 may vary according to each operation mode.

The control button is a button for adjusting the operating frequency of the compressor 3 and/or the rotation speed of the blower fan 32 of the air conditioner 1. According to the manipulation of the control button, the operating frequency of the compressor 3 and/or the rotation speed of the blower fan 32 may be adjusted.

The timer button is a button for setting the operating time of the air conditioner 1. The air conditioner 1 may perform an operation mode, which is selected by a user, for an operating time set by the timer button, and may terminate the operation mode when the operating time set by the timer button elapses.

The air conditioner 1 may process a user input received through the input interface 111 or output information related to the air conditioner 1 through the output interface 112.

For example, a user input received through the input interface 111 may be transmitted to the controller 160. As another example, the controller 160 may control the output interface 112 to output information related to the air conditioner 1.

The environmental sensor 120 may measure a temperature, humidity and quality of air around the air conditioner 1.

The environmental sensor 120 may include at least one temperature sensor 121, at least one humidity sensor 122, and/or at least one gas sensor 123.

Sensor data collected by the environmental sensor 120 may include temperature data, humidity data and/or air quality data. The temperature data may include temperature data of air that did not pass through the heat exchanger 20 (hereinafter 'intake air') and temperature data of air that passes through the heat exchanger 20 (hereinafter 'discharge air'). Humidity data may include humidity data of intake air and humidity data of discharge air. The air quality data may include quality data of intake air and quality data of discharge air. Furthermore, the air quality data may include air quality data around the heat exchanger 20.

The at least one temperature sensor 121 may measure a temperature of air surrounding the air conditioner 1. The at least one temperature sensor 121 may transmit temperature data of the air surrounding the air conditioner 1 to the controller 160.

According to various embodiments, the at least one temperature sensor 121 may include a first temperature sensor configured to measure a temperature of air (intake air) drawn into the main body 10 from the outside of the main body 10, and/or a second temperature sensor configured to measure a temperature of air (discharge air) discharged from the inside of the main body 10 to the outside of the main body 10.

The first temperature sensor may be formed around the intake port 19. The first temperature sensor may measure the temperature of the intake air. The first temperature sensor may transmit temperature data of the intake air to the controller 160.

The second temperature sensor may be formed around the discharge plate 14. The second temperature sensor may measure the temperature of the discharge air. The second temperature sensor may transmit temperature data of the discharge air to the controller 160.

According to various embodiments, the at least one temperature sensor 121 may further include a temperature sensor configured to measure a temperature of air surrounding the outdoor unit 2.

A temperature of air surrounding the air conditioner 1 may be referred to as 'temperature of indoor air', and a temperature of air surrounding the outdoor unit 2 may be referred to as 'temperature of outdoor air'.

The at least one humidity sensor 122 may measure humidity of air around the air conditioner 1. The at least one humidity sensor 122 may transmit humidity data of the air surrounding the air conditioner 1 to the controller 160.

The at least one humidity sensor 122 may include a first humidity sensor configured to measure humidity of air drawn into the main body 10 from the outside of the main body 10, and/or a second humidity sensor configured to measure humidity of air discharged from the inside of the main body 10 to the outside of the main body 10.

The first humidity sensor may be formed around the intake port 19. The first humidity sensor may measure the humidity of the intake air. The first humidity sensor may transmit humidity data of the intake air to the controller 160.

The second humidity sensor may be formed around the discharge plate 14. The second humidity sensor may measure the humidity of the discharge air. The second humidity sensor may transmit humidity data of the discharge air to the controller 160.

According to various embodiments, the at least one humidity sensor 122 may further include a humidity sensor configured to measure humidity of air surrounding the outdoor unit 2.

Humidity of air surrounding the air conditioner 1 may be referred to as 'humidity of indoor air', and humidity of air surrounding the outdoor unit 2 may be referred to as 'humidity of outdoor air'.

The at least one gas sensor 123 may measure quality of air surrounding the air conditioner 1. The at least one gas sensor 123 may transmit quality data of air surrounding the air conditioner 1 to the controller 160.

The at least one gas sensor 123 may detect and measure the presence of gas in the surrounding environment, and may detect combustible gas, toxic gas, oxygen, carbon dioxide, etc.

For example, the at least one gas sensor 123 may detect Volatile Organic Compound (VOC).

Measuring air quality may include detecting combustible gas, toxic gas, oxygen, carbon dioxide, etc., contained in the air.

That air quality is bad may include that a concentration of combustible gas, toxic gas, oxygen, carbon dioxide, etc. is greater than or equal to a predetermined concentration.

The at least one gas sensor 123 may include a first gas sensor configured to measure quality of air drawn into the main body 10 from the outside of the main body 10, a second gas sensor configured to measure quality of air discharged from the inside of the main body 10 to the outside of the main body 10, and/or a third gas sensor installed around the heat exchanger 20 to measure quality of air around the heat exchanger 20.

The occupant detection sensor 124 may include at least one sensor configured to detect an occupant. For example, the occupant detection sensor 124 may include a lidar sensor, a radar sensor, an ultrasonic sensor, a camera sensor, etc., but examples of the occupant detection sensor 124 are not limited thereto. In the present disclosure, any sensor configured to detect an occupant may be employed as the occupant detection sensor 124.

In the present disclosure, a term 'occupant' may refer, for example, to a person in an indoor space in which the air conditioner 1 is installed.

For example, 'occupant' may refer, for example, to a person in a room, house or office in which the air conditioner 1 is installed.

In the present disclosure, 'inside the house' may refer, for example, to an inside of an indoor space in which the air conditioner 1 is installed.

The blower fan 32 may be rotated by a driving force supplied by the fan motor 33.

That the controller 160 controls the blower fan 32 may include that the controller 160 controls the fan motor 33. The controller 160 may control the rotation speed of the blower fan 32 by controlling the fan motor 33.

The circular fan 37 may be rotated by a driving force supplied by a fan motor of the circular fan 37.

That the controller 160 controls the circular fan 37 may include that the controller 160 controls the fan motor of the circular fan 37.

The sterilizing device 125 may be configured to sterilize the heat exchanger 20. For example, the sterilizing device 125 may include an ultraviolet irradiation portion configured to irradiate ultraviolet rays toward the heat exchanger 20. The sterilizing device 125 may include an electric dust collector configured to remove dust from air flowing toward the heat exchanger 20.

The sterilizing device 125 may be operated during the drying operation and/or the ventilation operation. In an embodiment, the sterilizing device 125 may be operated during the ventilation operation.

The compressor 3 may be operated based on a control signal from the controller 160.

The controller 160 may operate the compressor 3 based on the start of the cooling operation of the air conditioner 1.

The door actuator 66 may be operated based on a control signal from the controller 160.

As mentioned above, the controller 160 may control the door actuator 66 to open the discharge port 41 during the first cooling operation. In addition, the controller 160 may control the door actuator 66 to close the discharge port 41 during the second cooling operation.

The air conditioner 1 may include the communication interface 140 for communicating with an external device (e.g., the user device 6 and/or the computing device 7) wired and/or wirelessly.

The communication interface 140 may include various communication circuitry including at least one of a short-range communication module or a long-range communication module.

The communication interface 140 may transmit data to an external device (e.g., the user device 6 and/or the computing device 7) or receive data from the external device. For example, the communication interface 140 may establish communication with the user device 6 and/or the computing device 7 and transmit and receive various types of data.

For the communication, the communication interface 140 may establish a direct (e.g., wired) communication channel or a wireless communication channel between external devices, and support the performance of the communication through the established communication channel. According to an embodiment, the communication interface 140 may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, an ultrawideband (UWB) communication module, an Ant+communication module, a microwave (uWave) communication module, etc., but is not limited thereto.

The long-range wireless communication module may include a communication module that performs various types of long-range wireless communication, and may include a mobile communication interface. The mobile communication interface transmits and receives radio signals with at least one of a base station, an external terminal, and a server on a mobile communication network According to an embodiment, the communication interface 140 may communicate with an external device, such as the user device 6 and/or the computing device 7, through an access point (AP). The access point (AP) may connect a local area network (LAN), to which the air conditioner 1 and/or the user device 6 is connected, to a wide area network (WAN) to which the computing device 7 is connected. The air conditioner may be connected to the computing device 7 through the wide area network (WAN).

The communication interface 140 may include a receiving antenna configured to receive radio waves output from a surrounding access point (AP). Radio waves received by the receiving antenna may be transmitted to the controller 160.

In an embodiment, the communication interface 140 may receive an image inside the house from an external device (e.g., a home cam that obtains an image of an inside of the house).

The controller 160 may process a user command received from the input interface 111.

The controller 160 may process data collected from various sensors (e.g., the environmental sensor 120 and the occupant detection sensor 124).

The controller 160 may process a user command received from through the communication interface 140.

The controller 160 may control various components of the air conditioner 1 (e.g., the output interface 112, the compressor 3, the blower fan 32, the circular fan 37, the sterilizing device 125, the door actuator 66, and/or the communication interface 140).

The controller 160 may include at least one processor (e.g., including processing circuitry) 161 configured to control the operation of the air conditioner 1, and at least one memory 162 provided to store programs and data for controlling the operation of the air conditioner 1.

The at least one memory 162 may store data necessary for various embodiments. The memory 162 may be implemented as a memory embedded in the air conditioner 1 or as a memory removable from the air conditioner 1 depending on the data storage purpose. For example, data for driving the air conditioner 1 may be stored in a memory embedded in the air conditioner 1, and data for the expansion function of the air conditioner 1 may be stored in a memory that is removable from the air conditioner 1. Meanwhile, the memory embedded in the air conditioner 1 may be implemented as at least one of volatile memory (e.g., dynamic RAM (DRAM), static RAM (SRAM), or synchronous dynamic RAM (SDRAM), etc.), and non-volatile memory (e.g., one time programmable ROM (OTPROM), programmable ROM (PROM), erasable and programmable ROM (EPROM), electrically erasable and programmable ROM (EEPROM), mask ROM, flash ROM, flash memory (e.g. NAND flash or NOR flash, etc.), hard drive, or solid state drive (SSD)). The memory removable from the air conditioner 1 may be implemented as a memory card (e.g., compact flash (CF), secure digital (SD), micro secure digital (Micro-SD), mini secure digital (Mini-SD), extreme digital (xD), multi-media card (MMC), etc.), and external memory (e.g., USB memory) that is connectable to a USB port.

The at least one memory 162 may store an algorithm for performing the cooling operation, the drying operation, and the ventilation operation.

The at least one processor 161 may include various processing circuitry and controls the overall operation of the air conditioner 1. For example, the at least one processor 161 may be connected to each component of the air conditioner 1 and control the overall operation of the air conditioner 1. For example, the at least one processor 161 may be electrically connected to the memory 162 to control the overall operation of the air conditioner 1. The processor 161 may be include one or multiple processors.

By executing at least one instruction stored in the memory 162, the at least one processor 161 may perform the operation of the air conditioner 1 according to various embodiments.

The at least one processor 161 may include at least one of a Central Processing Unit (CPU), a Graphics Processing Unit (GPU), an Accelerated Processing Unit (APU), a Many Integrated Core (MIC), a Digital Signal Processor (DSP), a Neural Processing Unit (NPU), a hardware accelerator or a machine learning accelerator. The at least one processor 161 may control one or any combination of the other components of the air conditioner 1 and may perform operations related to the communication or the data processing. The at least one processor 161 may execute at least one program or instruction stored in the memory 162. For example, the at least one processor 161 may perform one method according to various embodiments of the present disclosure by executing at least one instruction stored in the memory 162. The at least one processor 161 may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

The at least one memory 162 may store an algorithm for controlling the compressor 3, the blower fan 32, the circular fan 37, and/or the sterilizing device 125 according to the operation mode of the air conditioner 1.

Configurations shown in FIG. 12 are examples of the configurations of the air conditioner 1, and the air conditioner 1 according to an embodiment may further include some configurations in addition to the configurations illustrated in FIG. 12, and conversely, may not include some of the configurations illustrated in FIG. 12 (e.g., the door actuator 66, the circular fan 37, the gas sensor 123, the occupant detection sensor 124, and/or the sterilizing device 125).

It is illustrated that the air conditioner 1 according to an embodiment of the present disclosure is a stand-type air conditioner, but the air conditioner 1 according to an embodiment is not limited thereto. Alternatively, the air conditioner 1 may include various types of air conditioners such as a ceiling-type air conditioner and a window-type air conditioner.

The user device 6 according to an embodiment may include a user interface device (e.g., including interface circuitry) 610, a communication interface (e.g., including communication circuitry) 640, and a controller (e.g., including various processing circuitry and a memory) 660.

The user interface device 610 may include various interface circuitry and allow a user and the user device 6 to interact with each other.

The user interface device 610 may include an output interface 612 and an input interface 611.

At least one output interface 612 may transmit various information to a user by generating sensory information.

For example, the at least one output interface 612 may transmit information related to an operation or status of the air conditioner connected to the user device 6 to a user. Various pieces of information may be output through a display, an indicator, and/or a voice. The at least one output interface 612 may include a Liquid Crystal Display (LCD) panel, an indicator, a Light Emitting Diode (LED) panel, a speaker, etc.

In an embodiment, the at least one output interface 612 may output sensory information (e.g., visual information, auditory information, etc.) related to the setting of the air conditioner 1.

The at least one input interface 611 may convert sensory information received from a user into an electrical signal.

The at least one input interface 611 may receive a user input for manipulating an interface element included in an interface provided by the user device 6.

Each interface element may include a visual indicator (e.g. text, icon, etc.) provided to indicate a function thereof.

The at least one input interface 611 may include a tact switch, a push switch, a slide switch, a toggle switch, a micro switch, a touch switch, a touch pad, a touch screen, a jog dial, and/or a microphone, etc.

The user device 6 may process a user input received through the input interface 611 or output information related to the user device 6 through the output interface 612.

For example, a user input received through the input interface 611 may be transmitted to the controller 660. As another example, the controller 660 may control the output interface 612 to output various pieces of information.

The controller 660 may process a user input received from the input interface 611.

The controller 660 may process data received from an external device (e.g., the air conditioner 1 and/or the computing device 7) via the communication interface 640.

The controller 660 may transmit a user input received through the input interface 611 to an external device (e.g., the air conditioner 1 and/or the computing device 7) through the communication interface 640.

The controller 660 may control various components of the user device 6 (e.g., the output interface 612 and the communication interface 640).

The controller 660 may include at least one processor 661 configured to control the operation of the user device 6, and at least one memory 662 provided to store programs and data for controlling the operation of the user device 6.

The at least one memory 662 may store data necessary for various embodiments. The memory 662 may be implemented as a memory embedded in the user device 6 or as a memory removable from the user device 6 depending on the data storage purpose. For example, data for driving the user device 6 may be stored in a memory embedded in the user device 6, and data for the expansion function of the user device 6 may be stored in a memory that is removable from the user device 6. Meanwhile, the memory embedded in the user device 6 may be implemented as at least one of volatile memory (e.g., dynamic RAM (DRAM), static RAM (SRAM), or synchronous dynamic RAM (SDRAM), etc.), and non-volatile memory (e.g., one time programmable ROM (OTPROM), programmable ROM (PROM), erasable and programmable ROM (EPROM), electrically erasable and programmable ROM (EEPROM), mask ROM, flash ROM, flash memory (e.g. NAND flash or NOR flash, etc.), hard drive, or solid state drive (SSD)). The memory removable from the user device 6 may be implemented as a memory card (e.g., compact flash (CF), secure digital (SD), micro secure digital (Micro-SD), mini secure digital (Mini-SD), extreme digital (xD), multi-media card (MMC), etc.), and external memory (e.g., USB memory) that is connectable to a USB port.

The at least one processor 661 may include various processing circuitry and controls the overall operation of the user device 6. For example, the at least one processor 661 may be connected to each component of the user device 6 and control the overall operation of the user device 6. For example, the at least one processor 661 may be electrically connected to the memory 662 to control the overall operation of the user device 6. The processor 661 may include one or multiple processors.

By executing at least one instruction stored in the memory 662, the at least one processor 661 may perform the operation of the user device 6 according to various embodiments.

The at least one processor 661 may include at least one of a Central Processing Unit (CPU), a Graphics Processing Unit (GPU), an Accelerated Processing Unit (APU), a Many Integrated Core (MIC), a Digital Signal Processor (DSP), a Neural Processing Unit (NPU), a hardware accelerator or a machine learning accelerator. The at least one processor 661 may control one or any combination of the other components of the user device 6 and may perform operations related to the communication or the data processing. The at least one processor 661 may execute at least one program or instruction stored in the memory 662. For example, the at least one processor 661 may perform one method according to various embodiments of the present disclosure by executing at least one instruction stored in the memory 662. The at least one processor 661 may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

The at least one memory 662 may store an algorithm for providing an interface for changing setting of the air conditioner 1.

The communication interface 640 may include various communication circuitry including at least one of a short-range communication module or a long-range communication module.

The communication interface 640 may transmit data to an external device (e.g., the air conditioner 1 and/or the computing device 7) or receive data from the external device. For example, the communication interface 640 may establish communication with the air conditioner 1 and/or the computing device 7 and transmit and receive various types of data.

For the communication, the communication interface 640 may establish a direct (e.g., wired) communication channel or a wireless communication channel between external devices, and support the performance of the communication through the established communication channel. According to an embodiment, the communication interface 640 may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, an ultrawideband (UWB) communication module, an Ant+communication module, a microwave (uWave) communication module, etc., but is not limited thereto.

The long-range wireless communication module may include a communication module that performs various types of long-range wireless communication, and may include a mobile communication interface. The mobile communication interface transmits and receives radio signals with at least one of a base station, an external terminal, and a server on a mobile communication network.

The computing device 7 according to an embodiment may include a processor (e.g., including processing circuitry) 761, a memory 762 and/or a communication interface (e.g., including communication circuitry) 740.

The processor 761 may include various processing circuitry and process data received from the communication interface 740.

For example, the processor 761 may process data collected from an external device (e.g., the air conditioner 1 and/or the user device 6) through the communication interface 740.

The processor 761 may control the overall operation of the computing device 7.

The computing device 7 may include at least one memory 762 provided to store programs and data for controlling the operation of the computing device 7.

The at least one memory 762 may store data necessary for various embodiments. The memory 762 may be implemented as a memory embedded in the computing device 7 or as a memory removable from the computing device 7 depending on the data storage purpose. For example, data for driving the computing device 7 may be stored in a memory embedded in the computing device 7, and data for the expansion function of the computing device 7 may be stored in a memory that is removable from the computing device 7. Meanwhile, the memory embedded in the computing device 7 may be implemented as at least one of volatile memory (e.g., dynamic RAM (DRAM), static RAM (SRAM), or synchronous dynamic RAM (SDRAM), etc.), and non-volatile memory (e.g., one time programmable ROM (OTPROM), programmable ROM (PROM), erasable and programmable ROM (EPROM), electrically erasable and programmable ROM (EEPROM), mask ROM, flash ROM, flash memory (e.g. NAND flash or NOR flash, etc.), hard drive, or solid state drive (SSD)). The memory removable from the computing device 7 may be implemented as a memory card (e.g., compact flash (CF), secure digital (SD), micro secure digital (Micro-SD), mini secure digital (Mini-SD), extreme digital (xD), multi-media card (MMC), etc.), and external memory (e.g., USB memory) that is connectable to a USB port.

The at least one processor 761 may control the overall operation of the computing device 7. For example, the at least one processor 761 may be connected to each component of the computing device 7 and control the overall operation of the computing device 7. For example, the at least one processor 761 may be electrically connected to the memory 762 to control the overall operation of the computing device 7. The processor 761 may include one or multiple processors.

By executing at least one instruction stored in the memory 762, the at least one processor 761 may perform the operation of the computing device 7 according to various embodiments.

The at least one processor 761 may include at least one of a Central Processing Unit (CPU), a Graphics Processing Unit (GPU), an Accelerated Processing Unit (APU), a Many Integrated Core (MIC), a Digital Signal Processor (DSP), a Neural Processing Unit (NPU), a hardware accelerator or a machine learning accelerator. The at least one processor 761 may control one or any combination of the other components of the computing device 7 and may perform operations related to the communication or the data processing. The at least one processor 761 may execute at least one program or instruction stored in the memory 762. For example, the at least one processor 761 may perform at least one method according to an embodiment of the present disclosure by executing at least one instruction stored in the memory 762. The at least one processor 761 may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

The at least one memory 762 may store an algorithm for processing data received from an external device (e.g., the air conditioner 1 and/or the user device 6).

The communication interface 740 may include various communication circuitry including at least one of a short-range communication module or a long-range communication module.

The communication interface 740 may transmit data to an external device (e.g., the air conditioner 1 and/or the user device 6) or receive data from the external device. For example, the communication interface 740 may establish communication with the air conditioner 1 and/or the user device 6 and transmit and receive various types of data.

For the communication, the communication interface 740 may establish a direct (e.g., wired) communication channel or a wireless communication channel between external devices, and support the performance of the communication through the established communication channel. According to an embodiment, the communication interface 740 may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant+communication module, a microwave (uWave) communication module, etc., but is not limited thereto.

The long-range wireless communication module may include a communication module that performs various types of long-range wireless communication, and may include a mobile communication interface. The mobile communication interface transmits and receives radio signals with at least one of a base station, an external terminal, and a server on a mobile communication network.

When a method according to various embodiments of the present disclosure includes a plurality of operations, the plurality of operations may be performed by one processor 161, 661 or 761 or by the plurality of processors 161, 661 and 761. For example, when a first operation, a second operation, and a third operation are performed by the method according to various embodiments, the first operation, the second operation, and the third operation may be all performed by a first processor. Alternatively, the first operation and the second operation may be performed by the first processor (e.g., a general-purpose processor) and the third operation may be performed by a second processor (e.g., an artificial intelligence-specific processor).

The at least one processor 161, 661 and 761 may be implemented as a single core processor including one core or as at least one multi-core processor including a plurality of cores (e.g., homogeneous multi-core or heterogeneous multi-core). When the at least one processor 161, 661 and 761 is implemented as a multi-core processor, each of the plurality of cores included in the multi-core processor may include processor internal memory such as cache memory and on-chip memory, and a common cache shared by a plurality of cores may be included in the multi-core processor. In addition, each of the plurality of cores (or some of the plurality of cores) included in the multi-core processor may independently read and execute program instructions for implementing the method according to various embodiments of the present disclosure. Further, the entire (or some) of the plurality of cores may be linked so as to read and perform program instructions for implementing the method according to various embodiments of the present disclosure.

When a method according to various embodiments of the present disclosure includes a plurality of operations, the plurality of operations may be performed by one core among a plurality of cores included in a multi-core processor, or by a plurality of cores. For example, when a first operation, a second operation, and a third operation are performed by the method according to various embodiments, the first operation, the second operation, and the third operation may be performed by a first core included in the multi-core processor, or the first operation and the second operation may be performed by the first core included in the multi-core processor and the third operation may be performed by a second core included in the multi-core processor.

In various embodiments of the present disclosure, the processor 161, 661 and 761 may refer to a system-on-chip (SoC) in which at least one processor and other electronic components are integrated, a single-core processor, a multi-core processor, or a core included in a single-core processor or a multi-core processor. The core may be implemented as CPU, GPU, APU, MIC, DSP, NPU, hardware accelerator, or machine learning accelerator, but the various embodiments of the present disclosure are not limited thereto.

According to various embodiments, the communication interface 140 of the air conditioner 1 may be directly connected (e.g., connected via a short-range communication module) to the communication interface 640 of the user device 6.

According to various embodiments, the communication interface 140 of the air conditioner 1 may be indirectly connected to the communication interface 640 of the user device 6 (e.g., connected via the communication interface 740 of the computing device 7).

Figure 13:
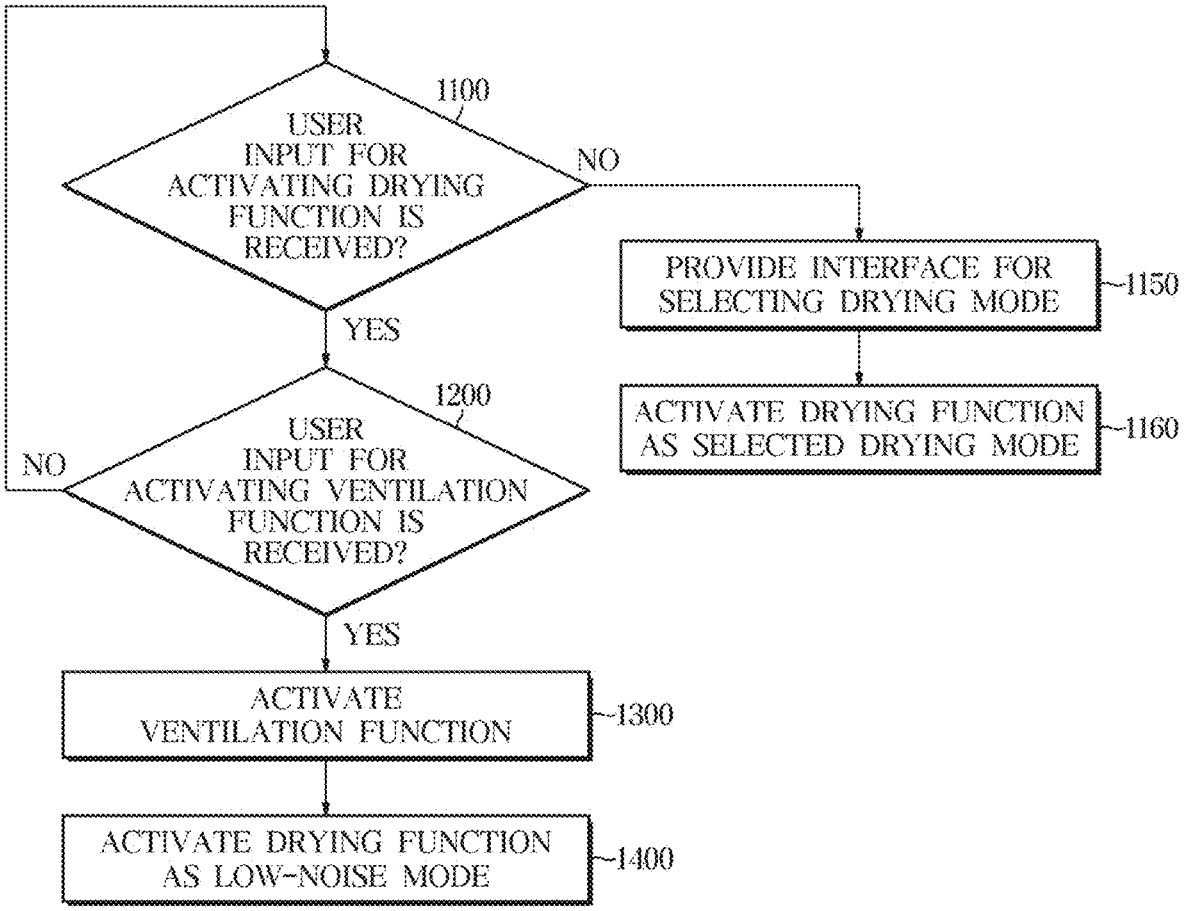
FIG. 13 is a flowchart illustrating an example method of activating a drying function and/or a ventilation function of the air conditioner according to various embodiments.

FIG. 13 is a flowchart illustrating an example method of activating a drying function and/or a ventilation function of the air conditioner according to various embodiments.

Referring to FIG. 13, the air conditioner 1 according to an embodiment may receive a user input for activating the drying function and/or the ventilation function (1100 and 1200).

Activating the drying function and/or the ventilation function may include turning on the drying function and/or the ventilation function.

Activating the drying function and/or the ventilation function may be the opposite of deactivating the drying function and/or the ventilation function or turning off the drying function.

Receiving a user input activating the drying function and/or the ventilation function may include receiving a user command activating the drying function and/or the ventilation function.

The user input that activates the drying function and/or ventilation function may be received by the air conditioner 1 in various ways.

In an embodiment, the air conditioner 1 may receive the user input activating the drying function and/or the ventilation function via the input interface 111.

For this, the air conditioner 1 may provide a user interface for activating or deactivating the drying function and/or the ventilation function through the user interface device 110.

In an embodiment, the air conditioner 1 may receive the user input activating the drying function and/or the ventilation function from an external device (e.g., the user device 6) via the communication interface 140.

For this, the user device 6 may provide a user interface for activating or deactivating the drying function and/or the ventilation function via the user interface device 610.

Figure 14:
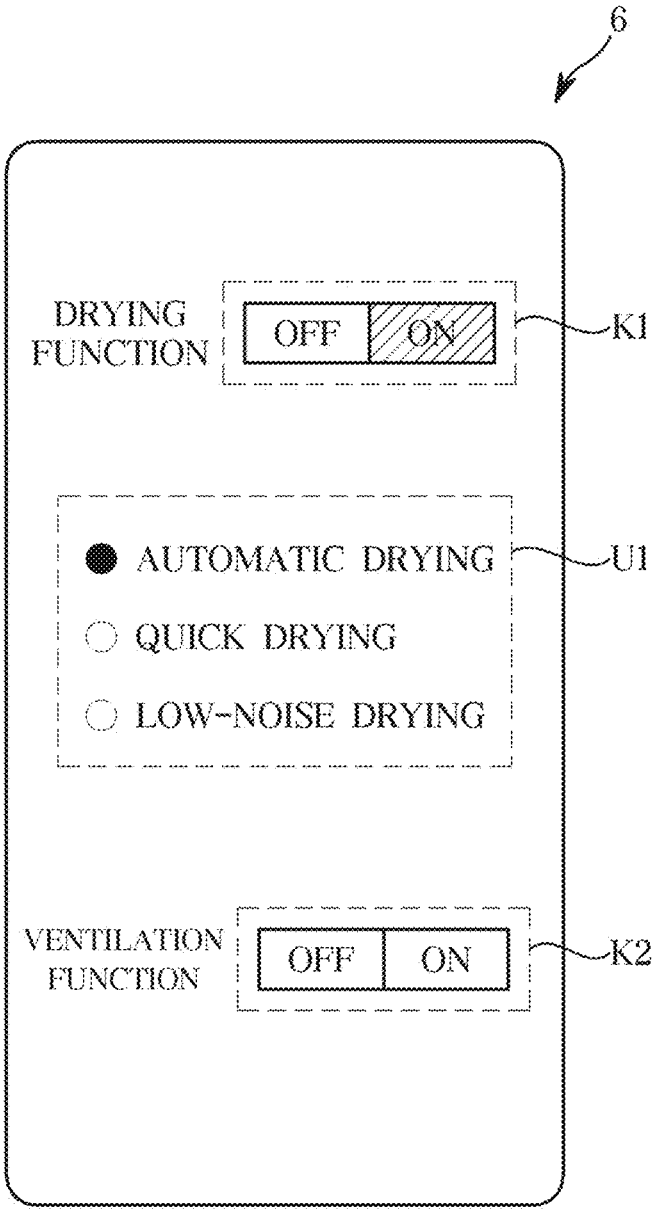
FIG. 14 is a diagram illustrating an example of an interface for setting the drying function and/or the ventilation function provided by a user device according to various embodiments.

FIG. 14 is a diagram illustrating an example of an interface for setting the drying function and/or the ventilation function provided by a user device according to various embodiments.

Referring to FIG. 14, the user device 6 may provide an interface for setting the drying function and/or the ventilation function.

A user can set the drying function and/or ventilation function using the user device 6.

Setting the drying function and/or the ventilation function may include activating or deactivating the drying function and/or the ventilation function, and setting the mode of the drying function and/or the ventilation function.

In an embodiment, the interface for setting the drying function and/or the ventilation function may include an interface element K1 for activating or deactivating the drying function and an interface element K2 for activating or deactivating the ventilation function.

When a user inputs a user input activating the drying function through the interface element K1 for activating or deactivating the drying function, the air conditioner 1 may activate the drying function.

For example, when a user inputs the user input activating the drying function through the user device 6, the user device 6 may transmit a control command to the air conditioner 1 to activate the drying function, and the air conditioner 1 may activate the drying function in response to receiving the control command for activating the drying function.

In an embodiment, when a user inputs the user input activating the drying function through the interface element K1 for activating or deactivating the drying function, an interface UI for setting the mode of the drying function may be provided.

For example, in operation 1150, the user device 6 may provide the interface UI for selecting the drying mode in response to receiving the user input activating the drying function (yes in 1100).

In an embodiment, when a user selects the drying mode through the interface UI for setting the mode of the drying function, the drying function may be activated as the selected drying mode (1160).

For example, the user device 6 may transmit information about the selected drying mode to the air conditioner 1 in response to receiving the user input for selecting the drying mode, and the air conditioner 1 may activate the drying function as the selected drying mode.

In an embodiment, an interface UI for setting the mode of the drying function may be provided while the drying function is deactivated, and in this case, when a user manipulation for selecting the mode of the drying function is performed through the interface UI for setting the mode of the drying function, the drying function may be automatically activated along with the selection of the mode of the drying function.

In an embodiment, the drying function may include a plurality of modes. For example, the drying function may include a first mode (e.g., an automatic drying mode), a second mode (e.g., a quick drying mode), and/or a third mode (e.g., a low-noise drying mode).

In an embodiment, when a user inputs the user input activating the drying function through the interface element K1 for activating or deactivating the drying function, the mode of the drying function may be automatically selected as the first mode (e.g., the automatic drying mode) among the plurality of modes. For example, when a user does not select the mode of the drying function through the interface UI for setting the mode of the drying function, the mode of the drying function may be automatically selected as the first mode (e.g., the automatic drying mode) among the plurality of modes.

Meanwhile, in an embodiment, when a user inputs the user input activating the drying function through the interface element K1 for activating or deactivating the drying function, the mode of the drying function may be automatically selected as a mode previously selected by the user among the plurality of modes.

The automatic drying mode may refer, for example, to a mode in which the air conditioner 1 performs an optimal drying operation based on environmental information around the air conditioner 1 (e.g., sensor data collected by the environmental sensor 120).

For example, when the drying function is selected as the automatic drying mode, the air conditioner 1 may perform the drying operation in response to the termination of the cooling operation, but may control the blower fan 32 based on the sensor data collected by the environmental sensor 120.

Controlling the blower fan 32 may include controlling the rotation speed of the blower fan 32 and/or the operating time of the blower fan 32.

The operating time of the blower fan 32 may refer, for example, to an execution time of the drying operation.

The quick drying mode may refer, for example, to a mode in which the air conditioner 1 performs the drying operation for a minimum time.

For example, when the drying function is selected as the quick drying mode, the air conditioner 1 may perform the drying operation in response to the termination of the cooling operation, but may control the rotation speed of the blower fan 32 to a first speed so as to minimize/reduce the execution time of the drying operation.

The low-noise drying mode may refer, for example, to a mode in which the air conditioner 1 performs the drying operation while generating minimal noise.

For example, when the drying function is selected as the low-noise drying mode, the air conditioner 1 may perform the drying operation in response to the termination of the cooling operation, but may control the rotation speed of the blower fan 32 to a second speed so as to minimize/reduce the noise generated during the drying operation. The second speed may be less than the first speed.

In an embodiment, an execution time of the drying operation in the quick drying mode may be longer than an execution time of the drying operation in the low-noise drying mode.

In an embodiment, the rotation speed of the blower fan 32 in the quick drying mode may be greater than the rotation speed of the blower fan 32 in the low-noise drying mode.

According to the present disclosure, it is possible to provide the air conditioner 1 configured to perform the drying operation that meets user needs, by allowing a user to easily select various modes of the drying function.

In an embodiment, when a user inputs the user input activating the drying function through the interface element K1 for activating or deactivating the drying function, the mode of the drying function may be automatically selected as the mode previously selected by the user among the plurality of modes.

When a user inputs a user input activating the ventilation function through the interface element K2 for activating or deactivating the ventilation function (yes in 1200), the air conditioner 1 may activate the ventilation function (1300).

For example, when a user inputs the user input activating the ventilation function through the user device 6, the user device 6 may transmit a control command to the air conditioner 1 to activate the ventilation function, and the air conditioner 1 may activate the ventilation function in response to receiving the control command for activating the ventilation function.

For example, the air conditioner 1 may activate the ventilation function (1300) in response to receiving the user input for activating the ventilation function (yes in 1200).

In an embodiment, the air conditioner 1 may activate the drying function as the third mode (e.g., low-noise mode) (1400) in response to receiving the user input for activating the ventilation function (yes in 1200).

That is, the air conditioner 1 may activate both the drying function and the ventilation function in response to receiving the user input activating the ventilation function while the drying function is deactivated.

Figure 15:
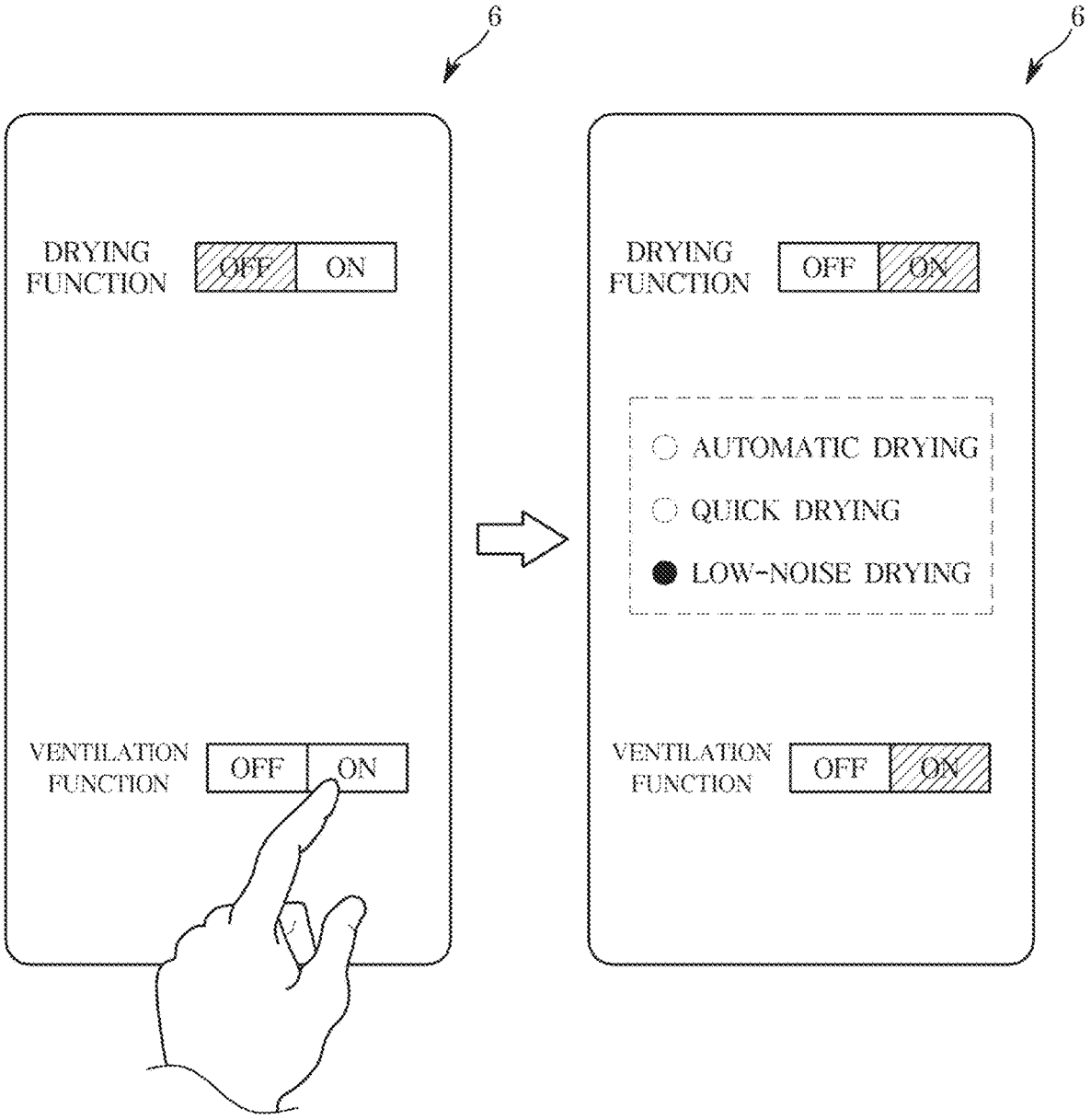
FIG. 15 is a diagram illustrating a state in which the drying function is automatically activated when the ventilation function of the air conditioner is activated according to various embodiments.

FIG. 15 is a diagram illustrating a state in which the drying function is automatically activated when the ventilation function of the air conditioner 1 is activated according to various embodiments.

Referring to FIG. 15, the user device 6 may control the interface element K1 for activating or deactivating the drying function to change the drying function to an activated state, in response to receiving a user input activating the ventilation function while the drying function is deactivated.

An intention of a user who wants to activate the ventilation function is to remove foreign substances (e.g., dust, organic chemicals, etc.) attached to the blower fan 32 and/or the heat exchanger 20. When only the ventilation function is activated and the drying function is not activated after the cooling operation is performed, moisture inside the air conditioner 1 (e.g., moisture around the heat exchanger 20) may not be removed, and thus there is a high possibility that microorganisms (e.g., mold) are generated and foreign substances (e.g., dust, organic chemicals, etc.) attached to the blower fan 32 and/or the heat exchanger 20 increase. The foreign substances may include not only foreign substances attached to the blower fan 32 and/or the heat exchanger 20, but also all substances remaining inside the main body 10 of the air conditioner 1.

For example, when the air conditioner 1 only performs the ventilation operation without the drying operation, the efficiency of the ventilation operation may decrease.

However, an intention of a user who activates only the ventilation function without activating the drying function may be that the user does not want to experience smell or noise generated by the operation of the air conditioner 1 when the user is located in the house.

In an embodiment, the air conditioner 1 may activate the drying function as the low-noise mode in response to receiving the user input activating the ventilation function while the drying function is deactivated.

A user who confirms that the drying function is automatically activated as the low-noise mode through the user device 6 can deactivate the drying function according to the user's intention or keep the drying function activated.

According to the present disclosure, it is possible to provide the air conditioner 1 capable of securing the efficiency of the ventilation function by automatically activating the drying function when the ventilation function is activated while the drying function is deactivated, and capable of partially satisfying the needs of a user who intend not to activate the drying function by activating the drying function as the low-noise mode.

According to the present disclosure, it is possible to provide the air conditioner 1 capable of setting the ventilation operation separately from the drying operation.

The air conditioner 1 may provide the interface for setting the above-mentioned drying function and/or ventilation function, and a user can set the drying function and/or the ventilation function using the user interface device 110 of the air conditioner 1.

Figure 16:
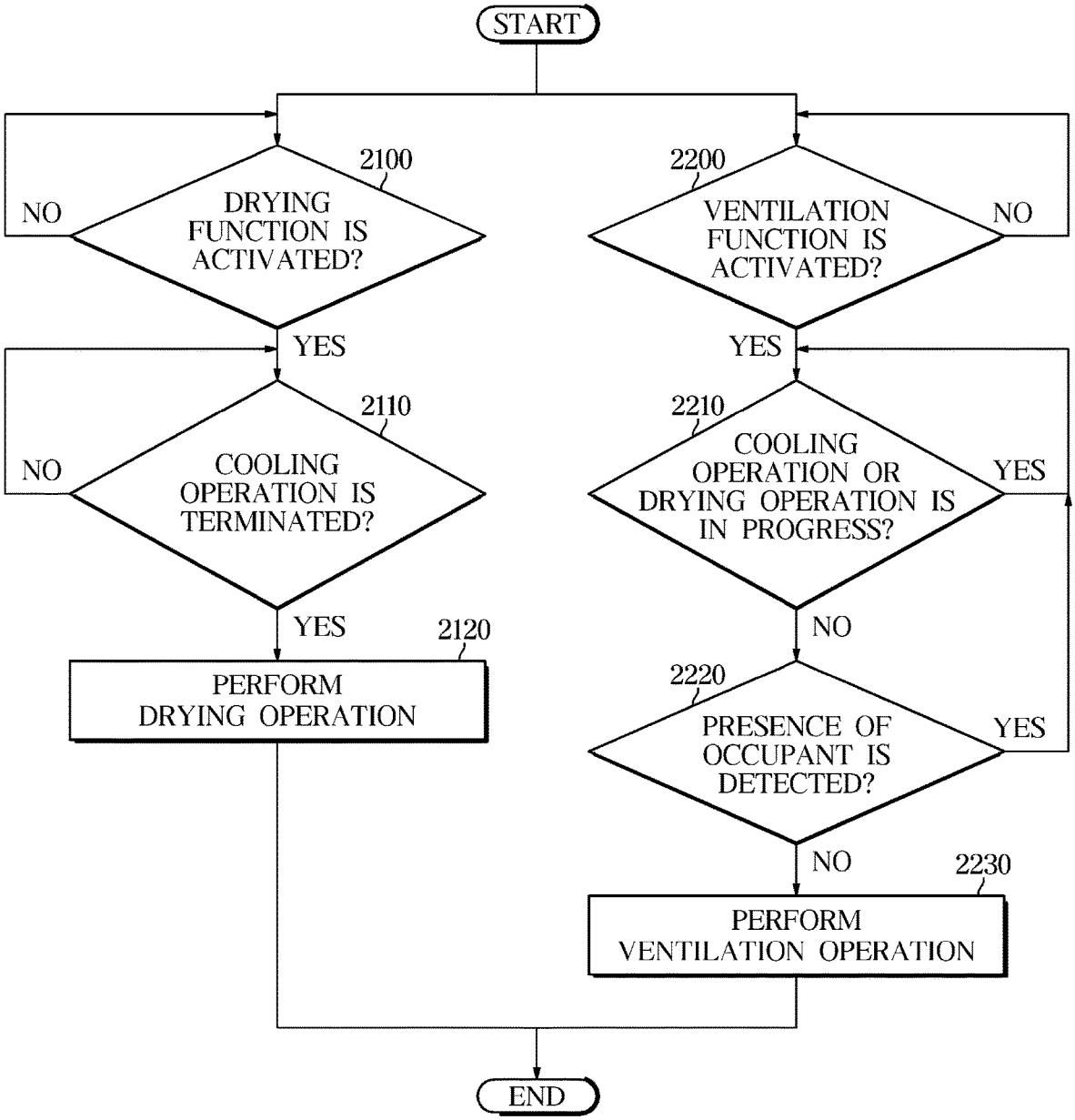
FIG. 16 is a flowchart illustrating an example control method of the air conditioner according to various embodiments.

FIG. 16 is a flowchart illustrating an example method of controlling the air conditioner 1 according to various embodiments.

Referring to FIG. 16, the controller 160 may control the air conditioner to perform the drying operation (2120) in response to the termination of the cooling operation (2110) while the drying function is activated (yes in 2100).

In an embodiment, regardless of the presence or absence of an occupant, the controller 160 may perform the drying operation in response to the termination of the cooling operation (2120).

As mentioned above, the drying operation may be performed with various algorithms according to the mode of the drying operation selected based on the user input.

The controller 160 may control the air conditioner to perform the ventilation operation (2230) in response to the presence of an occupant not being detected (no in 2220) in a state in which the cooling operation or the drying operation is not in progress (no in 2210) while the ventilation function is activated (yes in 2200).

For example, the controller 160 may control the air conditioner to perform the ventilation operation only when the presence of an occupant is not detected, separately from the drying operation.

In an embodiment, the controller 160 may transmit a message to the user device 6 asking whether to start the ventilation operation in response to the presence of an occupant not being detected (no in 2220) in the state in which the cooling operation or the drying operation is not in progress (no in 2210) while the ventilation function is activated (yes in 2200).

The user device 6 may provide a pop-up indicating whether to start the ventilation operation in response to receiving the message from the air conditioner 1 asking whether to start the ventilation operation.

The air conditioner 1 may start the ventilation operation in response to receiving a user's positive response from the user through the user device 6 or in response to the elapse of a predetermined of time after transmitting the message asking whether to start the ventilation operation.

According to the present disclosure, by reconfirming whether a user intends to perform the ventilation operation even when the presence of an occupant is not detected, it is possible to prevent or avoid a situation caused by inaccurately detecting the presence of an occupant.

The controller 160 may control the air conditioner to perform the drying operation by controlling the blower fan 32 based on a first operation profile (or a first algorithm), and perform the ventilation operation by controlling the blower fan 32 based on a second operation profile (or a second algorithm) different from the first operation profile.

The first operation profile and the second operation profile may be previously stored in the memory 162. The first operation profile and the second operation profile may include the speed and operating time of the blower fan 32.

The first operation profile may be changed according to the mode of the drying operation, and the second operation profile may also be changed according to the mode of the ventilation operation.

In an embodiment, the controller 160 may control the air conditioner to perform the ventilation operation by operating the circular fan 37 for a first predetermined time (e.g., about 3 minutes) and then operating the blower fan 32 for a second predetermined time (e.g., about 1 hour). The controller 160 may control the air conditioner to perform the drying operation by operating only the blower fan 32 without operating the circular fan 37.

The drying operation is an operation to remove moisture around the heat exchanger 20, and it is required that air is directly discharged to the outside of the air conditioner 1 by passing through the heat exchanger 20. On the other hand, the ventilation operation is an operation to circulate air inside the air conditioner 1 to remove foreign substances (e.g., dust, organic chemicals, etc.) attached to the blower fan 32 and/or the heat exchanger 20, and air needs to circulate inside the air conditioner 1.

For this, in an embodiment, the controller 160 may control the air conditioner to perform the drying operation by controlling the door actuator 66 to open the discharge port and operating the blower fan 32, and perform the ventilation operation by controlling the door actuator 66 to close the discharge port and operating the blower fan 32.

For example, the controller 160 may control the air conditioner to maintain the discharge port in an open state during the drying operation and may maintain the discharge port in a closed state during the ventilation operation.

The drying operation is performed regardless of the presence or absence of an occupant when the cooling operation is terminated, and the ventilation operation is performed only when no occupant is present. Accordingly, a user can expect that the ventilation operation is not performed when an occupant is present.

In an embodiment, in order to prevent and/or reduce that the presence of an occupant is falsely detected and the ventilation operation is performed, thereby disappointing the user's expectations, the controller 160 may control the air conditioner to perform the ventilation operation as the windless mode to allow noise to be minimally generated during the ventilation operation.

In an embodiment, the controller 160 may control the air conditioner to perform the drying operation as the blowing mode and the ventilation operation as the windless mode.

The blowing mode may be a mode in which the blower fan 32 operates while the discharge port is open, and the windless mode may be a mode in which the blower fan 32 and/or the circular fan 37 operate while the discharge port is closed.

When the blower fan 32 and/or the circular fan 37 operate while the discharge port is closed, air may circulate inside the air conditioner 1 and simultaneously may be naturally discharged to the outside of the air conditioner 1 through the discharge hole 42.

According to the present disclosure, because the operation profile of the drying operation and the operation profile of the ventilation operation are set differently according to purposes thereof, the purpose of each operation may be sufficiently obtained.

In an embodiment, the controller 160 may control the air conditioner to perform the ventilation operation at a predetermined period when a condition for performing the ventilation operation is satisfied. The condition for performing the ventilation operation may refer, for example, to the cooling operation and the drying operation not being performed and no occupant being detected while the ventilation function is activated.

For example, the controller 160 may control the air conditioner to perform a first ventilation operation in response to the condition for performing the ventilation operation being satisfied, and may perform a second ventilation operation in response to the condition for performing the ventilation operation being satisfied after a predetermined time (e.g., 1 day) elapses without performing the cooling operation after the first ventilation operation is performed.

For example, unlike the drying operation, the controller 160 may control the air conditioner to perform the ventilation operation by a plurality of times even after the cooling operation is performed by one time.

Even when the ventilation function is activated and the condition for performing the ventilation operation is satisfied, the ventilation operation may not need to be performed. For example, even when the ventilation function is activated and the condition for performing the ventilation operation is satisfied, the ventilation operation may not need to be performed when foreign substances are not attached to the blower fan 32 and/or the heat exchanger 20.

In an embodiment, the controller 160 may control the air conditioner to perform the ventilation operation in response to the presence of an occupant not being detected while the air quality measured by the gas sensor does not satisfy a predetermined reference.

For example, in an embodiment, the controller 160 may control the air conditioner to not perform the ventilation operation in response to the environmental sensor 120 detecting that no foreign substance is attached to the blower fan 32 and/or the heat exchanger 20, even when the condition for performing the ventilation operation is satisfied.

For example, the controller 160 may control the air conditioner to not perform the ventilation operation based on the air quality measured by the gas sensor 123 satisfies a predetermined reference even when the condition for performing the ventilation operation is satisfied. That the air quality satisfies the predetermined reference may include that the concentration of combustible gas, toxic gas, oxygen, carbon dioxide, etc. is less than or equal to the predetermined concentration.

In an embodiment, the controller 160 may control the air conditioner to operate the sterilizing device 125 while performing the ventilation operation. Because the purpose of the ventilation operation is to remove organic chemicals attached to the blower fan 32 and/or the heat exchanger 20, the efficiency of the ventilation operation may increase when the sterilizing device 125 is operated.

According to various embodiments, the controller 160 may control the air conditioner to operate the sterilizing device 125 even while performing the drying operation. Because the purpose of the drying operation is to remove moisture from the heat exchanger 20 and suppress the expression of microorganisms, the efficiency of suppressing the expression of microorganisms may increase when the sterilizing device 125 is operated.

The controller 160 may control the air conditioner to display the progress of the ventilation operation through the output interface 112 while performing the ventilation operation. The progress of the ventilation operation may indicate a remaining time.

After starting the ventilation operation because no occupant is detected, the air conditioner 1 may detect an occupant again.

When an occupant is detected again and the ventilation operation is terminated, it is difficult to achieve the purpose of the ventilation operation. However, only when no occupant is present, the ventilation operation is performed, and thus when an occupant is detected again after the ventilation operation is started, whether or not the ventilation operation is terminated may become an issue.

However, when an occupant is detected again, the occupant can stop the ventilation operation at any time by operating the air conditioner 1.

In an embodiment, the controller 160 may control the air conditioner to continue the ventilation operation even when the presence of an occupant is detected during the ventilation operation.

In an embodiment, the controller 160 may control the air conditioner to terminate the ventilation operation in response to receiving a user input for controlling the air conditioner 1 while performing the ventilation operation.

The user input for controlling the air conditioner 1 may be a user input for performing the cooling operation and/or another operation mode. The other operation modes may include a clean operation mode, a test operation mode, a refrigerant charging mode, a freeze cleaning mode, an artificial intelligence diagnosis mode, etc.

For example, even when the presence of an occupant is detected while performing the ventilation operation, the controller 160 may control the air conditioner to continue the ventilation operation unless the occupant inputs a command to control the air conditioner 1.

When the controller 160 controls the air conditioner to terminate the ventilation operation in response to receiving a user input for controlling the air conditioner 1 while performing the ventilation operation, the controller 160 may control the air conditioner to perform the operation according to the user input and then perform the ventilation operation again. When the controller 160 controls the air conditioner to perform the ventilation operation again, the controller 160 may control the air conditioner to resume the operation that is previously performed. For example, an execution time of the ventilation operation performed before performing the ventilation operation again may be considered when counting the total execution time of the ventilation operation.

The drying operation and the ventilation operation may be performed only when the air conditioner 1 is not operated in another operation mode, as well as when the condition described above is satisfied and.

The controller 160 may control the air conditioner to perform the drying operation (2120) in response to the termination of the cooling operation (yes in 2110) while both the drying function and the ventilation function are activated (yes in 2100 and yes in 2200). The controller 160 may control the air conditioner to perform the ventilation operation (2230) in response to the presence of an occupant not being detected (no in 2220) after the termination of the drying operation (no in 2210).

The controller 160 may control the air conditioner to perform the ventilation operation (2230) in response to the presence of an occupant not being detected (no in 2220) after the termination of the cooling operation (no in 2210) while the drying function is deactivated (no in 2100) and the ventilation function is activated (yes in 2200).

The controller 160 may control the air conditioner to perform the drying operation (2120) in response to the termination of the cooling operation (yes in 2110) while the drying function is activated (yes in 2100) and the ventilation function is deactivated (no in 2200), and may not perform the ventilation operation even when the presence of an occupant is not detected after the termination of the drying operation.

The controller 160 may control the air conditioner to detect the presence of an occupant in various ways.

In an embodiment, the controller 160 may control the air conditioner to detect the presence of an occupant using the occupant detection sensor 124. However, in order to detect the presence of an occupant using the occupant detection sensor 124, it is required that the occupant detection sensor 124 is additionally provided, which increases the unit price of the air conditioner 1 and may consume power to operate the occupant detection sensor 124.

In an embodiment, the controller 160 may control the air conditioner to operate the occupant detection sensor 124 while the ventilation function is activated and the cooling operation or the drying operation is not in progress.

For example, when the air conditioner 1 is provided with the occupant detection sensor 124, the air conditioner 1 may operate the occupant detection sensor 124 in response to the termination of the cooling operation and/or the drying operation while the ventilation function is activated.

Operating the occupant detection sensor 124 may include turning on the occupant detection sensor 124 and applying power to the occupant detection sensor 124.

In an embodiment, the controller 160 may control the air conditioner to detect the presence of an occupant based on images received from an external device (e.g., a home cam) via the communication interface 140.

When the home cam is registered in association with a user account on the computing device 7, the computing device 7 may receive images of the house from the home cam, and the processor 761 may detect the presence of an occupant in the house based on the images processed in the house.

In an embodiment, the computing device 7 may transmit a command to start the ventilation operation to the air conditioner 1 in response to the presence of an occupant not being detected in the house while the ventilation function of the air conditioner 1 is activated.

In an embodiment, the air conditioner 1 may receive an image of the inside of the house from a home cam, and may detect the presence of an occupant in the house based on the image processed by the processor 161.

In an embodiment, the air conditioner 1 may prompt a user to input an absence time through the user interface device 110 and/or the user device 6, and the controller 160 may determine that no occupant is present during the absence time input by the user.

In an embodiment, the communication interface 140 may include an antenna that receives radio waves output from an access point (AP) connected to the air conditioner 1.

The controller 160 may also control the air conditioner to detect the presence or absence of an occupant based on the characteristics of radio waves received through the communication interface 140.

When the air conditioner 1 detects the presence or absence of an occupant based on the characteristics of the radio waves received through the communication interface 140, the air conditioner 1 does not need to be equipped with a separate sensor such as the occupant detection sensor 124, and it is not required to install additional means such as a home cam in the house.

Figure 17:
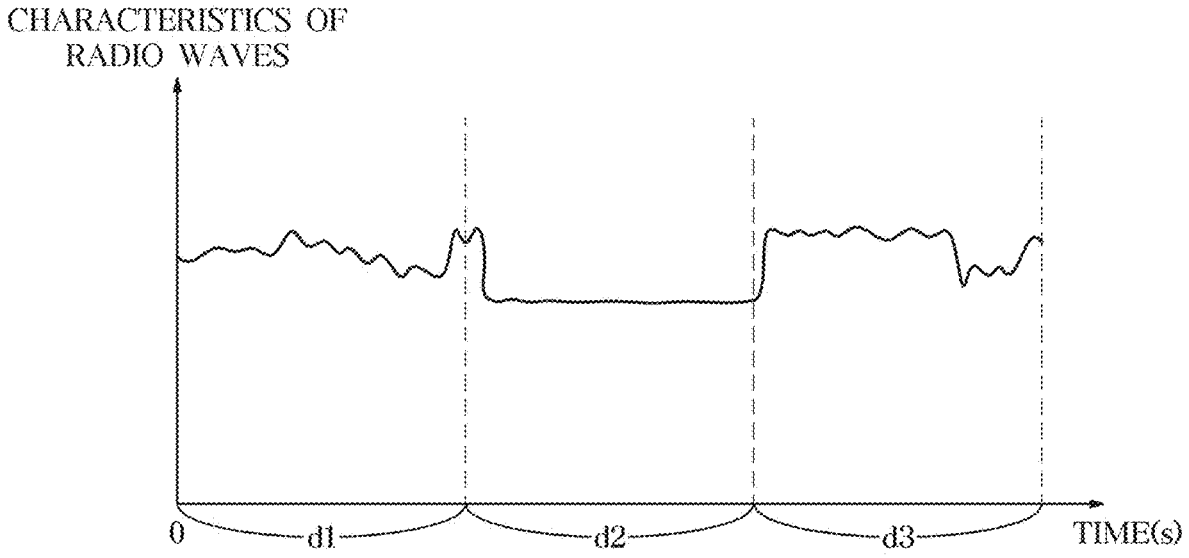
FIG. 17 is a graph illustrating an intensity of radio waves, received through a communication interface of the air conditioner over time according to various embodiments.
Figure 18:
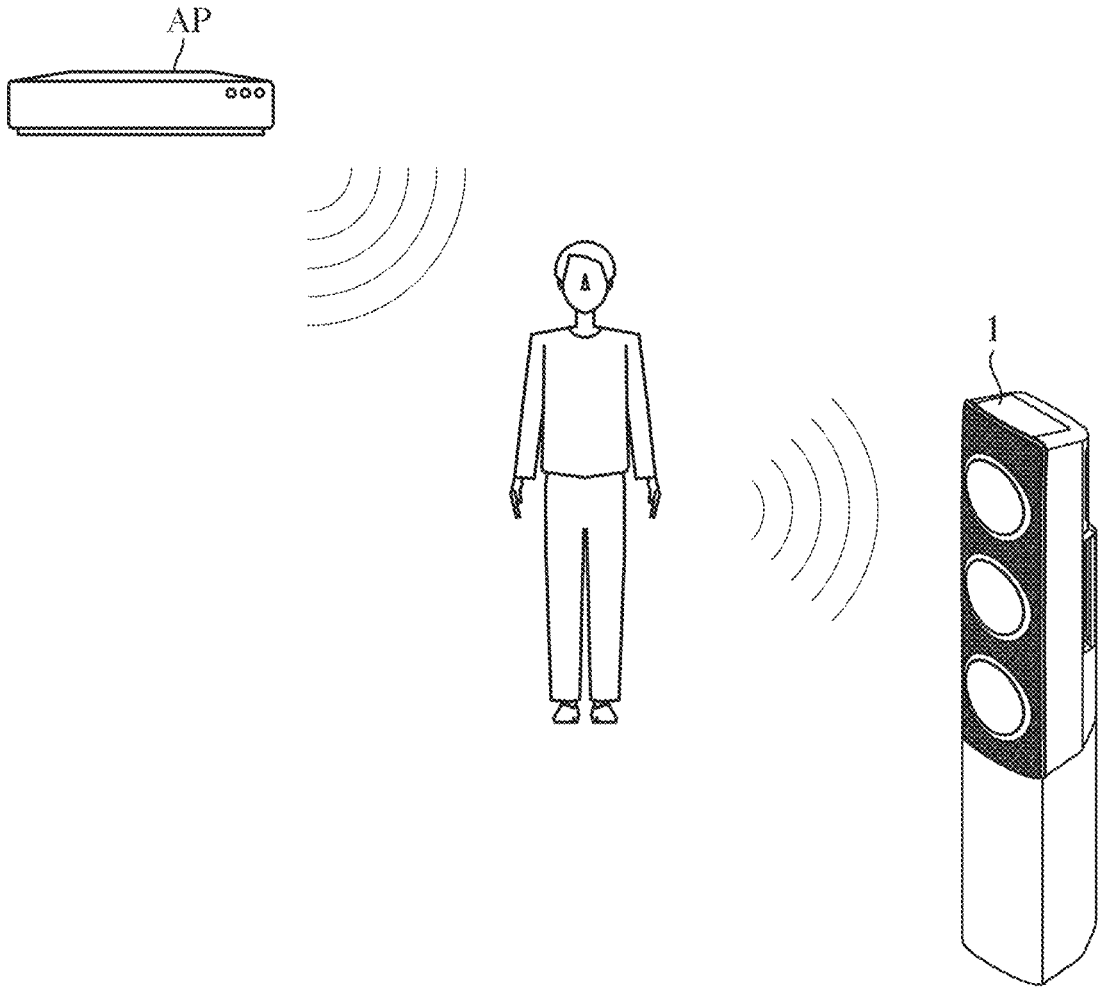
FIG. 18 is a diagram illustrating a state in which, when an occupant is present, characteristics of radio waves, which are output by an access point are changed and transmitted to the air conditioner according to various embodiments.

FIG. 17 is a graph illustrating an intensity of radio waves, which are received through the communication interface 140 of the air conditioner 1 over time according to various embodiments. FIG. 18 is a diagram illustrating a state in which, when an occupant is present, characteristics of radio waves, which are output by an access point are changed and transmitted to the air conditioner 1 according to various embodiments.

Radio waves output from the access point (AP) may travel through a space, in which the air conditioner 1 is installed, and reach the communication interface 140 of the air conditioner 1.

The radio waves output from the access point (AP) may be wireless communication signals (e.g., Wi-Fi signals). In an embodiment, the radio waves output from the access point (AP) may be 5 GHz channel signals, but the disclosure not limited thereto.

Referring to FIGS. 17 and 18, it can be confirmed that the characteristics (e.g., intensity) of radio waves output from the access point (AP) are changed depending on the presence or absence of an occupant.

The controller 160 may control the air conditioner to detect the presence or absence of an occupant based on Channel State Information (CSI) information of the radio waves output from the access point (AP).

When an occupant is present, the radio waves output from the access point (AP) are scattered, attenuated, and diffracted between the transmitting antenna of the access point (AP) and the receiving antenna (the communication interface 140) of the air conditioner 1, and thus the characteristics of the radio waves are changed.

For example, when an occupant is present, the radio waves output from the access point (AP) are scattered, attenuated, and diffracted, and thus the characteristics of the radio waves received through the communication interface 140 are continuously changed. For example, when an occupant is present, the intensity of the radio waves received through the communication interface 140 may be continuously changed.

On the other hand, when no occupant is present, the radio waves output from the access point (AP) reach the communication interface 140 without being scattered, attenuated, or diffracted, and thus the characteristics of the radio waves received through the communication interface 140 are not changed. For example, when no occupant is present, an amount of change in the intensity of the radio waves received through the communication interface 140 may be reduced.

The controller 160 may control the air conditioner to determine that an occupant is present in a section d1 or d3 in which the characteristics of the radio waves are continuously changed, and may determine that no occupant is present in a section d2 in which the characteristics of the radio waves are relatively not changed.

For this, the memory 162 may store an artificial intelligence model that is trained to detect the presence or absence of an occupant using the characteristics of radio waves as input data.

When a communication status between the access point (AP) and the air conditioner 1 is unstable, the characteristics of the radio waves may or may not be changed regardless of the presence or absence of an occupant.

The ventilation operation is performed only when no occupant is present, and thus it is appropriate that the ventilation operation is not performed when the presence or absence of an occupant is not accurately detected.

In an embodiment, the controller 160 may control the air conditioner to periodically identify the communication strength between the access point (AP) and the air conditioner 1, and when it is determined that the communication between the access point (AP) and the air conditioner 1 is unstable, the controller 160 may stop the operation of detecting the presence or absence of an occupant based on the characteristics of the radio waves.

For example, when the controller 160 determines that the communication between the access point (AP) and the air conditioner 1 is unstable, the controller 160 may temporarily deactivate the ventilation operation.

When the air conditioner 1 is configured to communicate with a plurality of access points (AP), the air conditioner 1 may more accurately determine the presence or absence of an occupant.

Figure 19:
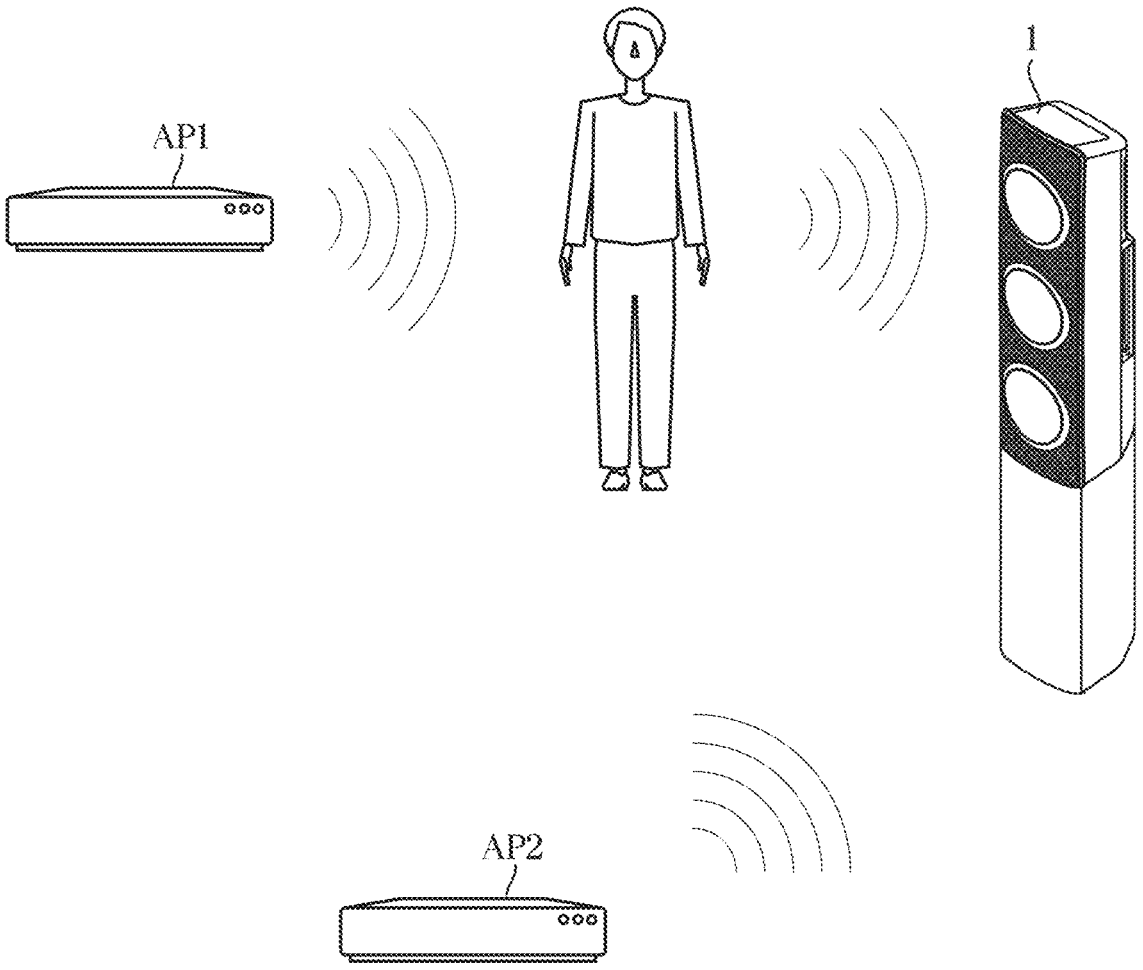
FIG. 19 is a diagram illustrating a state in which, when an occupant is present, characteristics of radio waves, which are output by a plurality of access points are changed and transmitted to the air conditioner according to various embodiments.

FIG. 19 is a diagram illustrating a state in which, when an occupant is present, characteristics of radio waves, which are output by a plurality of access points, are changed and transmitted to the air conditioner 1 according to various embodiments.

Referring to FIG. 19, a plurality of access points (AP1 and AP2) may be installed in an indoor space in which the air conditioner 1 is installed.

For example, the plurality of access points (AP1 and AP2) may include a first access point (AP1) configured to output a first radio wave and a second access point (AP2) configured to output a second radio wave.

The plurality of access points (AP1 and AP2) may each transmit and receive signals to and from the air conditioner 1.

When an occupant is present between the first access point (AP1) and the air conditioner 1 and when no occupant is present between the second access point (AP2) and the air conditioner 1, that is, when a distance between the second access point (AP2) and the air conditioner 1 is short or a space therebetween is narrow, radio waves output from the first access point (AP1) may be scattered, attenuated, or diffracted by the occupant, and thus the characteristics of the radio waves may be changed. However, radio waves output from the second access point (AP2) may be transmitted to the air conditioner 1 without changing the characteristics.

In this case, when the air conditioner 1 detects the presence or absence of an occupant based only on a change in the characteristics of the radio waves output from the second access point (AP2), the accuracy thereof may decrease.

In order to increase the accuracy of the detection of the presence or absence of an occupant, it is required to consider both the change in the characteristics of the first wave and the change in the characteristics of the second wave.

In an embodiment, when the presence of an occupant is not detected based on the characteristics of the first radio wave and when the present of an occupant is detected based on the characteristics of the second radio wave, the controller 160 may determine that the presence of the occupant is detected. When the presence of an occupant is not detected based on the characteristics of the first radio wave and when the present of an occupant is not detected based on the characteristics of the second radio wave, the controller 160 may determine that the presence of the occupant is not detected.

When a distance between the first access point (AP1) and the air conditioner 1 is far, and a distance between the second access point (AP2) and the air conditioner 1 is relatively short, the radio waves output from the first access point (AP1) may reach the air conditioner 1 with an intensity that is substantially reduced. However, the radio waves output from the second access point (AP2) may reach the air conditioner 1 with an intensity that is relatively not reduced.

In this case, when the air conditioner 1 detects the presence or absence of an occupant based on the change in the characteristics of the radio wave output from the first access point (AP1), the accuracy thereof may decrease.

The controller 160 may control the air conditioner to detect the presence or absence of an occupant based on characteristics of a radio wave with a relatively strong signal intensity between the first radio wave and the second radio wave.

For example, the controller 160 may control the air conditioner to detect the presence or absence of an occupant based on the characteristics of radio waves output from an access point with greater communication stability between the first access point (AP1) and the second access point (AP2).

According to the present disclosure, when the plurality of access points (AP1 and AP2) is configured to communicate with the air conditioner 1, the air conditioner 1 may more accurately detect the presence or absence of an occupant based on radio waves output from the plurality of access points (AP1 and AP2).

Figure 20:
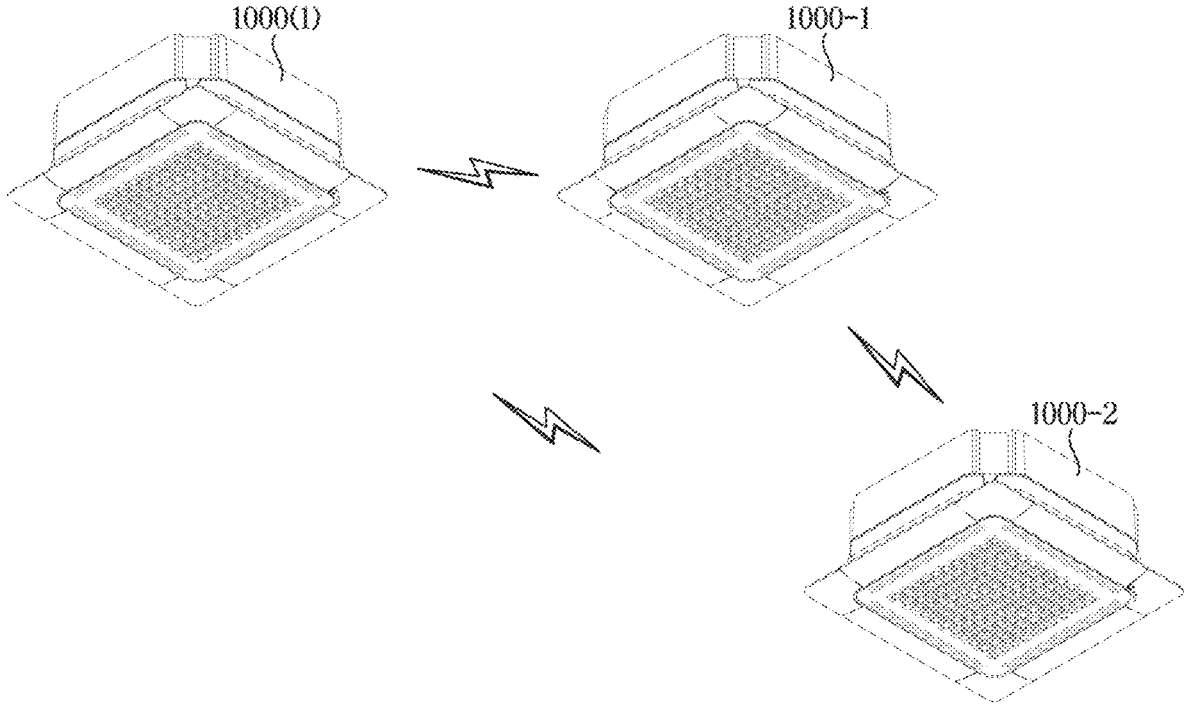
FIG. 20 is a diagram illustrating a state in which a plurality of air conditioners are installed according to various embodiments.

FIG. 20 is a diagram illustrating a state in which a plurality of air conditioners are installed according to various embodiments.

FIG. 20 illustrates that the air conditioner 1 is a ceiling-type air conditioner, but in an embodiment described in greater detail below, the air conditioner 1 may be various types of air conditioners, such as a stand-type air conditioner or a window-type air conditioner.

Referring to FIG. 20, a plurality of air conditioners 1000, 1000-1 and 1000-2 may be installed in a house.

The plurality of air conditioners 1000, 1000-1 and 1000-2 may communicate with each other wired or wirelessly.

Each of the plurality of air conditioners 1000, 1000-1 and 1000-2 may detect the presence or absence of an occupant in the manner described above, and each of the plurality of air conditioners 1000, 1000-1 and 1000-2 may perform the ventilation operation in response to the presence of an occupant not being detected in a state in which the cooling operation or the drying operation is not in progress while the ventilation function is activated.

When the condition for performing the ventilation operation is satisfied, the air conditioner 1 or 1000 according to an embodiment may perform the ventilation operation and transmit a command to start the ventilation operation to the other air conditioners 1000-1 and 1000-2. The other air conditioners 1000-1 and 1000-2 may start the ventilation operation in response to receiving the command to start the ventilation operation from the air conditioner 1 or 1000.

For example, when the presence of an occupant is not detected, the air conditioner 1 or 1000 according to an embodiment may simultaneously perform the ventilation operation together with the plurality of air conditioners 1000-1 and 1000-2 by linking to the plurality of air conditioners 1000-1 and 1000-2.

In an embodiment, when the presence of an occupant is not detected, the air conditioner 1 or 1000 according to an embodiment may perform the ventilation operation, and may also control the plurality of air conditioners 1000-1 and 1000-2 to perform the ventilation operation sequentially.

For example, the air conditioner 1 or 1000 according to an embodiment may perform the ventilation operation when the presence of an occupant is not detected, and the air conditioner 1 or 1000 may control the other air conditioners 1000-1 and 1000-2 to perform the ventilation operation when the ventilation operation of the air conditioner 1 or 1000 is terminated.

In this case, the air conditioner 1 or 1000 according to an embodiment may determine a sequence of the ventilation operation of the plurality of air conditioners 1000-1 and 1000-2.

In an embodiment, the sequence in which the ventilation operation is performed may be set by a user via the user device 6.

In an embodiment, the air conditioner 1 or 1000 may determine the sequence of the ventilation operations to allow the ventilation operation to be performed sequentially starting from the nearest air conditioner among the plurality of air conditioners 1000-1 and 1000-2.

According to the present disclosure, when the plurality of air conditioners 1000, 1000-1 and 1000-2 is installed in the house, the ventilation operation may be performed sufficiently and smoothly.

The air conditioner according to an example embodiment of the present disclosure may include: the main body including a discharge port, a heat exchanger, a compressor configured to compress a refrigerant supplied from the heat exchanger, blower fan configured to blow air, heat-exchanged by the heat exchanger, toward the discharge port, and a controller including at least one processor, comprising processing circuitry, individually and/or collectively, configured to perform a cooling operation by driving the compressor and the blower fan, and configured to perform a drying operation and a ventilation operation by driving the blower fan without driving the compressor. The controller may be configured to perform the drying operation to remove moisture inside the main body in response to the termination of the cooling operation based on the drying function being activated, and configured to perform the ventilation operation to clean the inside of the main body in response to the presence of an occupant not being detected in a state in which the cooling operation or the drying operation is not in progress based on the ventilation function being activated.

The controller may be configured to control the air conditioner to perform the drying operation in response to the termination of the cooling operation based on the drying function and the ventilation function being both activated, and to perform the ventilation operation in response to the presence of the occupant not being detected after the termination of the drying operation.

The controller may be configured to control the air conditioner to perform the drying operation by controlling the blower fan based on the first operation profile, and to perform the ventilation operation by controlling the blower fan based on the second operation profile different from the first operation profile.

The air conditioner may further include the circular fan configured to blow air that is not heat-exchanged by the heat exchanger.

The controller may be configured control the air conditioner to perform the ventilation operation by driving the circular fan for a first specified time and driving the blower fan for a second specified time.

The air conditioner may further include an actuator configured to open and close the discharge port.

The controller may be configured to control the air conditioner to perform the drying operation by controlling the actuator to open the discharge port and driving the blower fan, and to perform the ventilation operation by controlling the actuator to close the discharge port and driving the blower fan.

The controller may be configured to activate both the drying function and the ventilation function in response to receiving an input activating the ventilation function based on the drying function being deactivated.

The controller may be configured to control the air conditioner to continue the ventilation operation although the presence of the occupant is detected while performing the ventilation operation.

The controller may be configured to control the air conditioner to terminate the ventilation operation in response to receiving an input for controlling the air conditioner while performing the ventilation operation.

The air conditioner may further include a communication interface comprising communication circuitry configured to receive radio waves output from the access point.

The controller may be configured to detect the presence or absence of the occupant based on characteristics of radio waves received through the communication interface.

The access point may include the first access point configured to output the first radio wave, and the second access point configured to output the second radio wave.

The communication interface may be configured to receive the first radio wave and the second radio wave. The controller may be configured to detect the presence or absence of the occupant based on characteristics of a radio wave having a relatively strong signal intensity between the first radio wave and the second radio wave.

The controller may be configured to determine that the presence of the occupant is detected in response to the presence of the occupant not being detected based on characteristics of the first radio wave and in response to the presence of the occupant being detected based on characteristics of the second radio wave, and to determine that the presence of the occupant is not detected in response to the presence of the occupant not being detected based on the characteristics of the first radio wave and in response to the presence of the occupant not being detected based on the characteristics of the second radio wave.

The controller may be configured to detect the presence or absence of the occupant based on the characteristics of the radio wave in response to an intensity of the radio wave being greater than or equal to the predetermined intensity.

The air conditioner may further include the sterilizing device comprising circuitry configured to sterilize the heat exchanger.

The controller may be configured to drive the sterilizing device during the ventilation operation.

The air conditioner may further include the gas sensor configured to measure air quality.

The controller may be configured to control the air conditioner to perform the ventilation operation in response to the presence of the occupant not being detected while the air quality measured by the gas sensor does not satisfy the predetermined reference.

A method of controlling the air conditioner according to an example embodiment may include: performing a drying operation to remove moisture inside the air conditioner in response to termination of a cooling operation while the drying function is activated, and performing a ventilation operation to clean the inside of the air conditioner in response to presence of an occupant not being detected in a state in which the cooling operation or the drying operation is not in progress while the ventilation function is activated.

The method of controlling the air conditioner may further include performing the drying operation in response to the termination of the cooling operation while the drying function and the ventilation function are activated, and performing the ventilation operation in response to the presence of the occupant not being detected after the termination of the drying operation.

The performing of the ventilation operation may include driving a circular fan, which blows air that is not heat-exchanged by a heat exchanger, for a first specified time and then driving the blower fan for a second specified time The performing of the drying operation may include driving the blower fan while a discharge port is open, and the performing of the ventilation operation may include driving the blower fan while the discharge port is closed.

The method of controlling the air conditioner may further include activating both the drying function and the ventilation function in response to receiving an input activating the ventilation function while the drying function is deactivated.

The method of controlling the air conditioner 1 may further include continuing the ventilation operation although the presence of the occupant is detected while performing the ventilation operation.

As is apparent from the above description, the air conditioner 1 configured to remove organic chemicals attached to the inside of the main body of the air conditioner 1 by performing the ventilation operation, which is performed separately from the drying operation, and the control method thereof may be provided.

Further, the air conditioner configured to minimize and/or reduce user discomfort, which is caused by odor and noise generated when removing organic chemicals, by performing the ventilation operation only when no occupant is present, and the control method thereof may be provided.

Further, the air conditioner configured to facilitate setting of the drying operation and the ventilation operation, and the control method thereof may be provided.

Further, the air conditioner configured to detect the presence or absence of an occupant without a separate sensor, and the control method thereof may be provided.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a non-transitory computer-readable recording medium.

The computer-readable recording medium includes all kinds of recording media in which instructions which can be decoded by a computer are stored. For example, there may be a Read Only Memory (ROM), a Random Access Memory (RAM), a magnetic tape, a magnetic disk, a flash memory, and an optical data storage device.

Storage medium readable by machine, may be provided in the form of a non-transitory storage medium. "Non-transitory storage medium" may refer, for example, to a storage medium that is a tangible device and may not contain a signal (e.g., electromagnetic wave), and this term includes a case in which data is semi-permanently stored in a storage medium and a case in which data is temporarily stored in a storage medium. For example, "non-transitory storage medium" may include a buffer in which data is temporarily stored.

The method according to the various disclosed embodiments may be provided by being included in a computer program product. Computer program products may be traded between sellers and buyers as commodities. Computer program products are distributed in the form of a device-readable storage medium (e.g., compact disc read only memory (CD-ROM)), or are distributed directly or online (e.g., downloaded or uploaded) between two user devices (e.g., smartphones) through an application store (e.g., Play Store™). In the case of online distribution, at least a portion of the computer program product (e.g., downloadable app) may be temporarily stored or created temporarily in a device-readable storage medium such as the manufacturer's server, the application store's server, or the relay server's memory.

While the present disclosure has been illustrated and described with reference to various example embodiments, it will be understood that the various example embodiments are intended to be illustrative, not limiting. It will be further understood by those skilled in the art that various changes in form and detail may be made without departing from the true spirit and full scope of the present disclosure, including the appended claims and their equivalents. It will also be understood that any of the embodiment(s) described herein may be used in conjunction with any other embodiment(s) described herein.

What is claimed is:

1. An air conditioner comprising:

a main body comprising a discharge port;

a heat exchanger;

a compressor configured to compress a refrigerant supplied from the heat exchanger;

a blower fan configured to blow air, heat-exchanged by the heat exchanger, toward the discharge port; and a controller comprising at least one processor, comprising processing circuitry, individually and/or collectively, configured to control the air conditioner to perform a cooling operation by driving the compressor and the blower fan, a drying operation, and a ventilation operation by driving the blower fan without driving the compressor, wherein the controller is configured to control the air conditioner to:

based on a drying function being activated, perform the drying operation to remove moisture inside the main body in response to termination of the cooling operation, and based on a ventilation function being activated, perform the ventilation operation to clean an inside of the main body in response to the presence of an occupant not being detected in a state in which the cooling operation or the drying operation is not in progress.

2. The air conditioner of claim 1, wherein based on the drying function and the ventilation function being both activated, the controller is configured to control the air conditioner to:

perform the drying operation in response to the termination of the cooling operation and perform the ventilation operation in response to the presence of the occupant not being detected after the termination of the drying operation.

3. The air conditioner of claim 1, wherein the controller is configured to control the air conditioner to:

perform the drying operation by controlling the blower fan based on a first operation profile, and perform the ventilation operation by controlling the blower fan based on a second operation profile different from the first operation profile.

4. The air conditioner of claim 1, further comprising:

a circular fan configured to blow air that is not heat-exchanged by the heat exchanger, wherein the controller is configured to control the air conditioner to perform the ventilation operation by driving the circular fan for a first specified time and then driving the blower fan for a second specified time.

5. The air conditioner of claim 1, further comprising:

an actuator configured to open and close the discharge port, wherein the controller is configured to control the air conditioner to:

perform the drying operation by controlling the actuator to open the discharge port and by driving the blower fan, and perform the ventilation operation by controlling the actuator to close the discharge port and by driving the blower fan.

6. The air conditioner of claim 1, wherein the controller is configured to control the air conditioner to activate both the drying function and the ventilation function in response to receiving an input activating the ventilation function while the drying function is deactivated.

7. The air conditioner of claim 1, wherein the controller is configured to control the air conditioner to continue the ventilation operation although the presence of the occupant is detected while performing the ventilation operation.

8. The air conditioner of claim 1, wherein the controller is configured to control the air conditioner to terminate the ventilation operation in response to receiving an input for controlling the air conditioner while performing the ventilation operation.

9. The air conditioner of claim 1, further comprising:

a communication interface comprising communication circuitry configured to receive radio waves output from an access point, wherein the controller is configured to detect the presence or absence of the occupant based on characteristics of radio waves received through the communication interface.

10. The air conditioner of claim 9, wherein:

the access point comprises a first access point configured to output a first radio wave; and a second access point configured to output a second radio wave, wherein the communication interface is configured to receive the first radio wave and the second radio wave, wherein the controller is configured to detect the presence or absence of the occupant based on characteristics of a radio wave having a relatively strong signal intensity between the first radio wave and the second radio wave.

11. The air conditioner of claim 9, wherein the access point comprises a first access point configured to output a first radio wave; and a second access point configured to output a second radio wave, wherein the communication interface is configured to receive the first radio wave and the second radio wave, wherein the controller is configured to determine that the presence of the occupant is detected in response to the presence of the occupant not being detected based on characteristics of the first radio wave and in response to the presence of the occupant being detected based on characteristics of the second radio wave; and to determine that the presence of the occupant is not detected in response to the presence of the occupant not being detected based on the characteristics of the first radio wave and in response to the presence of the occupant not being detected based on the characteristics of the second radio wave.

12. The air conditioner of claim 9, wherein the controller is configured to detect the presence or absence of the occupant based on the characteristics of the radio wave based on an intensity of the radio wave being greater than or equal to a specified intensity.

13. The air conditioner of claim 1, further comprising:

a sterilizing device comprising circuitry configured to sterilize the heat exchanger, wherein the controller is configured to drive the sterilizing device during the ventilation operation.

14. The air conditioner of claim 1, further comprising:

a gas sensor configured to measure air quality, wherein the controller is configured to control the air conditioner to perform the ventilation operation in response to the presence of the occupant not being detected while the air quality measured by the gas sensor does not satisfy a specified reference.

15. A method of controlling an air conditioner configured to perform (i) a cooling operation by driving a compressor configured to compress a refrigerant supplied from a heat exchanger and by driving a blower fan configured to blow air, heat-exchanged by the heat exchanger, toward a discharge port, (ii) a drying operation, and (iii) a ventilation operation by driving the blower fan without driving the compressor, the method comprising:

based on a drying function being activated, performing the drying operation to remove moisture inside the air conditioner in response to termination of the cooling operation; and based on a ventilation function being activated, performing the ventilation operation to clean an inside of the air conditioner in response to the presence of an occupant not being detected in a state in which the cooling operation or the drying operation is not in progress.

16. The method of claim 15, wherein based on the drying function and the ventilation function being both activated:

performing the drying operation in response to the termination of the cooling operation and performing the ventilation operation in response to the presence of the occupant not being detected after the termination of the drying operation.

17. The method of claim 15, further comprising:

performing the drying operation by controlling the blower fan based on a first operation profile, and performing the ventilation operation by controlling the blower fan based on a second operation profile different from the first operation profile.

18. The method of claim 15, further comprising:

performing the ventilation operation by driving a circular fan for a first specified time and then driving the blower fan for a second specified time.

19. The method of claim 15, further comprising:

performing the drying operation by controlling an actuator to open the discharge port and by driving the blower fan, and performing the ventilation operation by controlling the actuator to close the discharge port and by driving the blower fan.

20. The method of claim 15, further comprising:

activating both the drying function and the ventilation function in response to receiving an input activating the ventilation function while the drying function is deactivated.

* * * * *